US009897979B2

(12) United States Patent
Fujisawa

(10) Patent No.: US 9,897,979 B2
(45) Date of Patent: Feb. 20, 2018

(54) ELECTRONIC TIMEPIECE AND CONTROL METHOD OF AN ELECTRONIC TIMEPIECE

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 63 days.

(21) Appl. No.: 15/171,011

(22) Filed: Jun. 2, 2016

(65) Prior Publication Data

US 2016/0357160 A1 Dec. 8, 2016

(30) Foreign Application Priority Data

Jun. 5, 2015 (JP) ..... 2015-114682

(51) Int. Cl.
*G04R 20/02* (2013.01)

(52) U.S. Cl.
CPC ..... *G04R 20/02* (2013.01)

(58) Field of Classification Search
CPC ..... G04R 20/00; G04R 20/02; G04R 20/08
See application file for complete search history.

(56) References Cited

U.S. PATENT DOCUMENTS 8,644,117 B2 * 2/2014 Matsuzaki ..... G04R 20/04 368/47
8,995,235 B2 3/2015 Honda et al.
9,760,062 B2 * 9/2017 Achanta ..... G04F 10/10
2009/0129208 A1 * 5/2009 Weiss ..... G04R 20/00 368/56
2013/0051187 A1 * 2/2013 Matsuzaki ..... G04R 20/04 368/47
2014/0114608 A1 * 4/2014 Achanta ..... G01S 19/23 702/176
2015/0198928 A1 * 7/2015 Hasegawa ..... G04R 20/04 368/10

FOREIGN PATENT DOCUMENTS

JP 2008-051697 A 3/2008
JP 2009-014668 A 1/2009
JP 2013-050347 A 3/2013

* cited by examiner

*Primary Examiner* — Sean Kayes
(74) *Attorney, Agent, or Firm* — Harness, Dickey & Pierce, P.L.C.

(57) ABSTRACT

An electronic timepiece having a satellite signal receiver; a standard time signal receiver; a storage battery; a voltage detection circuit that detects the remaining capacity of the storage battery; a satellite signal reception controller; and a standard time signal reception controller. The satellite signal reception controller operates the satellite signal receiver when the battery capacity detected by the voltage detection circuit is greater than or equal to a first threshold and the automatic reception condition is met. The standard time signal reception controller operates the standard time signal receiver when the automatic reception condition for the standard time signal is met whether the reserve power is greater than or equal to the first threshold and when the reserve power is less than the first threshold.

10 Claims, 19 Drawing Sheets

ELECTRONIC TIMEPIECE AND CONTROL METHOD OF AN ELECTRONIC TIMEPIECE

BACKGROUND

1. Technical Field

The present invention relates to an electronic timepiece and a control method of an electronic timepiece that receives satellite signals from GPS satellites, for example, or standard time signals from a transmission station, acquires time information, and corrects the time.

2. Related Art

Electronic timepieces that receive satellite signals from GPS satellites or standard time signals from long-wave standard time signal transmission stations, acquire time information, and correct the time, are known from the literature. See, for example, JP-A-2008-51697.

When the remaining battery capacity of the battery in an electronic timepiece is low, there is a chance that the battery voltage will drop to the system shutdown level of the controller chip if the signal reception operation is executed. It is therefore desirable to check the battery voltage before operating the reception unit, and apply control to not run the reception operation if the battery level is less than a specific value.

The power required to drive a satellite signal receiver that receives satellite signals is approximately 500 times the power required to drive a standard time signal receiver, however.

Therefore, if a value that will not drop to the system shutdown level if the satellite signal receiver operates is set as the threshold value of the battery voltage for automatically executing the reception process, the automated reception process will not execute even if the battery voltage is a level at which the standard time signal receiver can operate. The deviation of the time kept by the timekeeping device may therefore increase compared with when the automated reception process is executed by the standard time signal receiver.

SUMMARY

The present invention is directed to an electronic timepiece having a satellite signal receiver and a standard time signal receiver, and a control method of an electronic timepiece, that can increase opportunities for operating the standard time signal receiver and can minimize deviation in the internal time kept by the timekeeping device.

An electronic timepiece has: a satellite signal receiver that receives satellite signals and acquires time information; a standard time signal receiver that receives a standard time signal and acquires time information; a battery that supplies power to the satellite signal receiver and the standard time signal receiver; a reserve power detector that detects the reserve power of the battery; a satellite signal reception controller that controls operation of the satellite signal receiver when a previously set automatic reception condition for the satellite signal is met; and a standard time signal reception controller that controls operation of the standard time signal receiver when a previously set automatic reception condition for the standard time signal is met. The satellite signal reception controller operates the satellite signal receiver if the automatic reception condition for the satellite signal is met and the reserve power detected by the reserve power detector is greater than or equal to a first threshold; and does not operate the satellite signal receiver if the automatic reception condition for the satellite signal is met and the reserve power detected by the reserve power detector is less than the first threshold. The standard time signal reception controller operates the standard time signal receiver if the automatic reception condition for the standard time signal is met when the reserve power detected by the reserve power detector is greater than or equal to the first threshold and when the reserve power is less than the first threshold.

Because the electronic timepiece has reception units for receiving two types of signals, a satellite signal receiver and a standard time signal receiver, the probability of being able to acquire time information can be improved. Furthermore, because the satellite signal receiver is set to operate by the satellite signal reception controller only if the automatic reception condition is met when the battery voltage is greater than or equal to a first threshold, the system can be reliably prevented from shutting down due to the battery voltage dropping as a result of the satellite signal receiver operating. Because the standard time signal receiver is set to operate by the standard time signal reception controller even if the battery voltage is less than the first threshold, the standard time signal receiver can operate when the battery voltage is less than the first threshold. As a result, more opportunities for the standard time signal receiver to operate can be created, and deviation in the kept time can be reduced.

Preferably in an electronic timepiece according to another aspect, the standard time signal reception controller determines the automatic reception condition for the standard time signal is met and operates the standard time signal receiver when the time kept by the electronic timepiece reaches a previously set reception time; and the satellite signal reception controller operates the satellite signal receiver when the standard time signal receiver operated by the standard time signal reception controller does not succeed at acquiring time information by receiving the standard time signal, the electronic timepiece is determined to be outdoors, and the reserve power is greater than or equal to the first threshold.

The standard time signal reception controller can also execute the standard time signal reception process every day at a scheduled time because the standard time signal receiver operates when the kept time reaches a set reception time. Because the satellite signal reception controller operates the satellite signal receiver only when receiving a standard time signal reception and acquiring time information is not successful, the satellite signal receiver can be operated when operation of the standard time signal receiver is prioritized but a standard time signal cannot be received, and when a standard time signal was received but time information could not be acquired. As a result, time information can be acquired by the low current consumption standard time signal receiver when the electronic timepiece is used in a place where a standard time signal can be received, and time information can be acquired by the satellite signal receiver when in a location where a standard time signal cannot be received. Power consumption by the reception process for acquiring time information can therefore be suppressed.

Further preferably in an electronic timepiece according to another aspect, the satellite signal receiver can execute a timekeeping reception process to acquire time information based on the satellite signal, and a positioning reception process to calculate positioning information based on the satellite signal; and when the located identified by the positioning information acquired by the positioning reception process is outside a previously set standard time signal reception area, the standard time signal reception controller does not operate the standard time signal receiver, and the satellite signal reception controller operates the satellite signal receiver if the reserve power is greater than or equal to the first threshold and the electronic timepiece is determined to be outdoors.

Because whether or not the location enables receiving a standard time signal is determined from the positioning information acquired by the positioning reception process, unnecessary operation of the standard time signal receiver when not in an area where a standard time signal can be received can be prevented.

Further preferably, the satellite signal receiver can execute a timekeeping reception process to acquire time information based on the satellite signal, and a positioning reception process to calculate positioning information based on the satellite signal; and the satellite signal reception controller operates the satellite signal receiver and executes the timekeeping reception process when a previously set timekeeping reception condition is met and the reserve power is greater than or equal to the first threshold, and operates the satellite signal receiver and executes the positioning reception process when a previously set positioning reception condition is met and the reserve power is greater than or equal to a second threshold that is greater than the first threshold.

Because the positioning reception process, which consumes more power than the timekeeping reception process, executes only when the power reserve is greater than or equal to a second threshold, which is higher than the first threshold, battery power can be reliably prevented from dropping to the system shutdown level by the positioning reception process. Furthermore, because the first threshold can be set based on the current consumption of the timekeeping reception process, more opportunities to execute the timekeeping reception process can be created than if the first threshold is set according to the positioning reception process.

Further preferably, the satellite signal reception controller operates the satellite signal receiver when a reception operation of an operating member is detected, and the reserve power is greater than or equal to a threshold that is lower than the threshold set for the automatic reception condition.

The satellite signal reception controller operates the satellite signal receiver if the reception operation of an operating member such as a button disposed to the electronic timepiece is performed and the reserve battery power is greater than or equal to a threshold. Because this threshold is lower than the threshold for the automated reception process, more opportunities to execute the satellite signal reception process when the user starts reception manually can be created. A drop in user convenience resulting from the reception process not executing in response to this reception operation can therefore be prevented.

An electronic timepiece according to another aspect preferably also has a solar cell; and a power output detector that detects the power output of the solar cell. The satellite signal reception controller determines whether or not the electronic timepiece is outdoors based on the power output detected by the power output detector, and determines the automatic reception condition for the satellite signal is met if the electronic timepiece is determined to be outdoors.

Because being outdoors can be determined by the power output detector detecting the power output of the solar cell, the satellite signal reception controller can determine if the electronic timepiece is outdoors where satellite signal reception is easy. The probability of satellite signal reception succeeding automatically can therefore be improved.

An electronic timepiece according to another aspect preferably also has a display able to display the reserve power detected by the reserve power detector, and the display displays the reserve power at least when reception starts.

Because the electronic timepiece has a display for displaying the remaining battery capacity, the remaining battery capacity can be displayed when reception starts, and the user can know if the reception process did not execute because of a low battery. Because the user can thus know why reception failed, the user can take appropriate action to charge the battery to meet the reception condition, and user convenience can be improved.

An electronic timepiece according to another aspect preferably also has a hand; and a motor that drives the hand; the standard time signal receiver includes a bar antenna for receiving a standard time signal; and the satellite signal receiver has a ring antenna for receiving a satellite signal. The motor, the bar antenna, and the battery are disposed in a plan view of the electronic timepiece on the inside circumference side of the ring antenna at mutually non-overlapping plane positions.

Thus comprised, the thickness of the electronic timepiece can be minimized because parts that are relatively thick, such as the ring antenna, motor, bar antenna, and battery are disposed at positions not overlapping each other in plan view.

An electronic timepiece according to another aspect preferably also has a hand; and a motor that drives the hand; and the standard time signal receiver includes a bar antenna for receiving a standard time signal; and the satellite signal receiver includes a patch antenna for receiving a satellite signal. The motor, the bar antenna, the patch antenna, and the battery are disposed in a plan view of the electronic timepiece at mutually non-overlapping plane positions.

Thus comprised, the thickness of the electronic timepiece can be minimized because parts that are relatively thick, such as the patch antenna, motor, bar antenna, and battery are disposed at positions not overlapping each other in plan view.

Another aspect is a control method of an electronic timepiece including a satellite signal receiver that receives satellite signals and acquires time information; a standard time signal receiver that receives a standard time signal and acquires time information; a battery that supplies power to the satellite signal receiver and the standard time signal receiver; a reserve power detector that detects the reserve power of the battery; and a reception controller. The control method comprises steps of the reception controller: operating the satellite signal receiver if the automatic reception condition for the satellite signal is met when the reserve power detected by the reserve power detector is greater than or equal to a first threshold; not operating the satellite signal receiver if the automatic reception condition for the satellite signal is met when the reserve power detected by the reserve power detector is less than the first threshold; and operating the standard time signal receiver if the automatic reception condition for the standard time signal is met when the reserve power detected by the reserve power detector is greater than or equal to the first threshold or is less than the first threshold.

This aspect has the same effect as the electronic timepiece described above.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. In this embodiment, the crystal 33 side of the electronic timepiece 1 is the face (top, front), and the back cover 34 side is the back (bottom).

Electronic Timepiece

Figure 1:
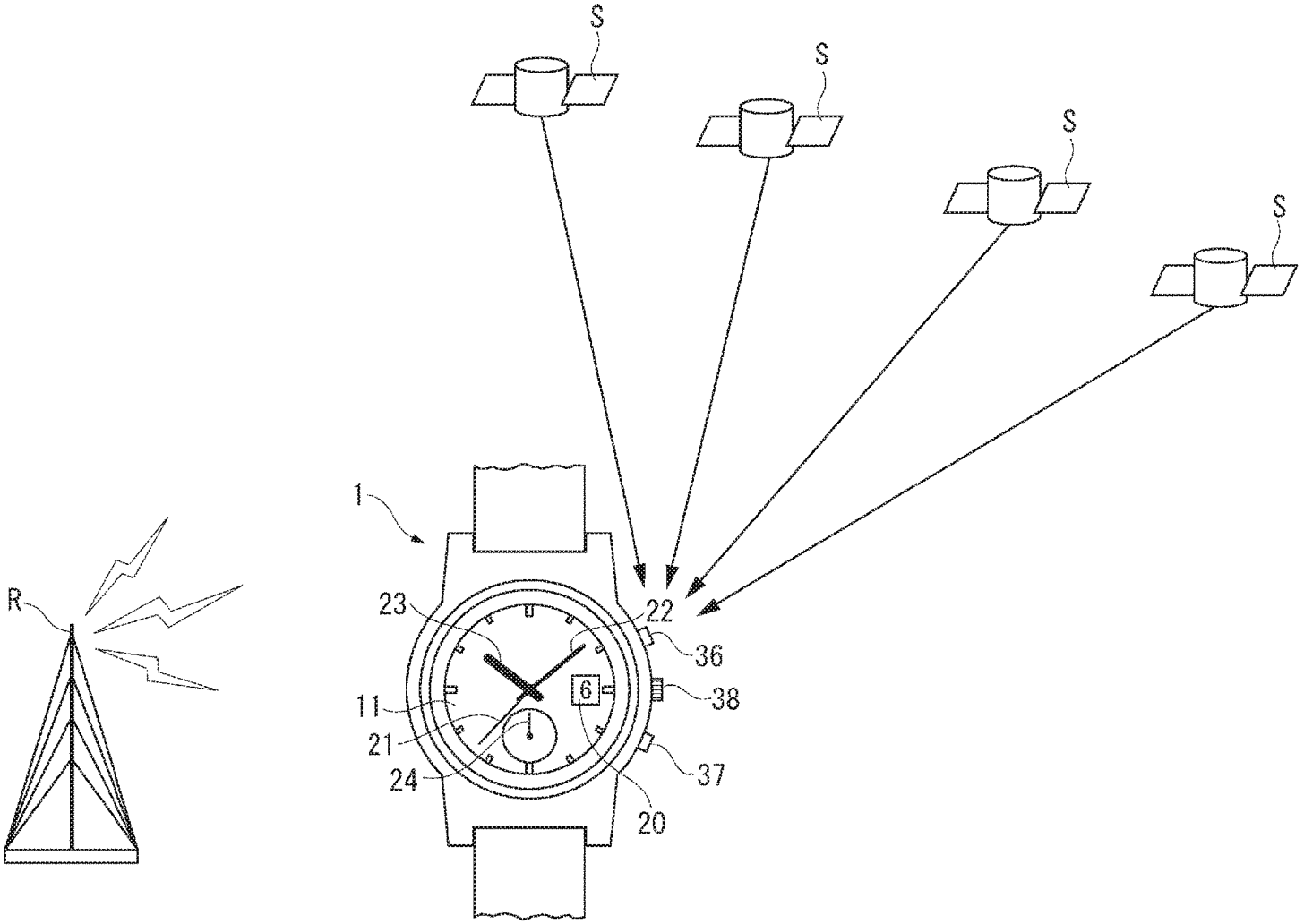
FIG. 1 is a plan view showing an electronic timepiece according to a preferred embodiment.

As shown in FIG. 1, the electronic timepiece 1 is configured to receive both standard time signals from a standard time signal receiver R, and satellite signals from a plurality of GPS satellites orbiting the Earth on specific known orbits.

The electronic timepiece 1 is configured to receive standard time signals from a standard time signal transmitter R and acquire time information for the country where the transmitter R is located.

The electronic timepiece 1 is configured to execute a reception process in a timekeeping mode (timekeeping reception process), and a reception process in a positioning mode (positioning reception process). The timekeeping mode is a mode in which satellite signals are received from one or more GPS satellites, and the internal time of the electronic timepiece 1 is corrected based on the time information contained in the satellite signals.

The positioning mode is a mode in which satellite signals are received from three or more (and preferably four or more) GPS satellites, the distance from the electronic timepiece 1 to each of the GPS satellites S and the current location of the electronic timepiece 1 are calculated using the orbit information and time information contained in the satellite signals, the time zone information of the time indicated by the electronic timepiece 1 is corrected based on the current position of the electronic timepiece 1, and the internal time of the electronic timepiece 1 is corrected based on the time information and time zone information acquired from the satellite signals.

When time information is received from a standard time signal, the electronic timepiece 1 corrects the internal time information, which is kept internally by the electronic timepiece 1, based on the received time information. When time information is received from satellite signals, the electronic timepiece 1 can correct the internal time information based on the received time information and the time zone information.

The time zone information can be set based on the positioning information calculated from the satellite signals, and map information stored in the electronic timepiece 1. The user may also manually select and set the time zone information by operating a button or the crown of the electronic timepiece 1.

Configuration of the Electronic Timepiece

Figure 2:
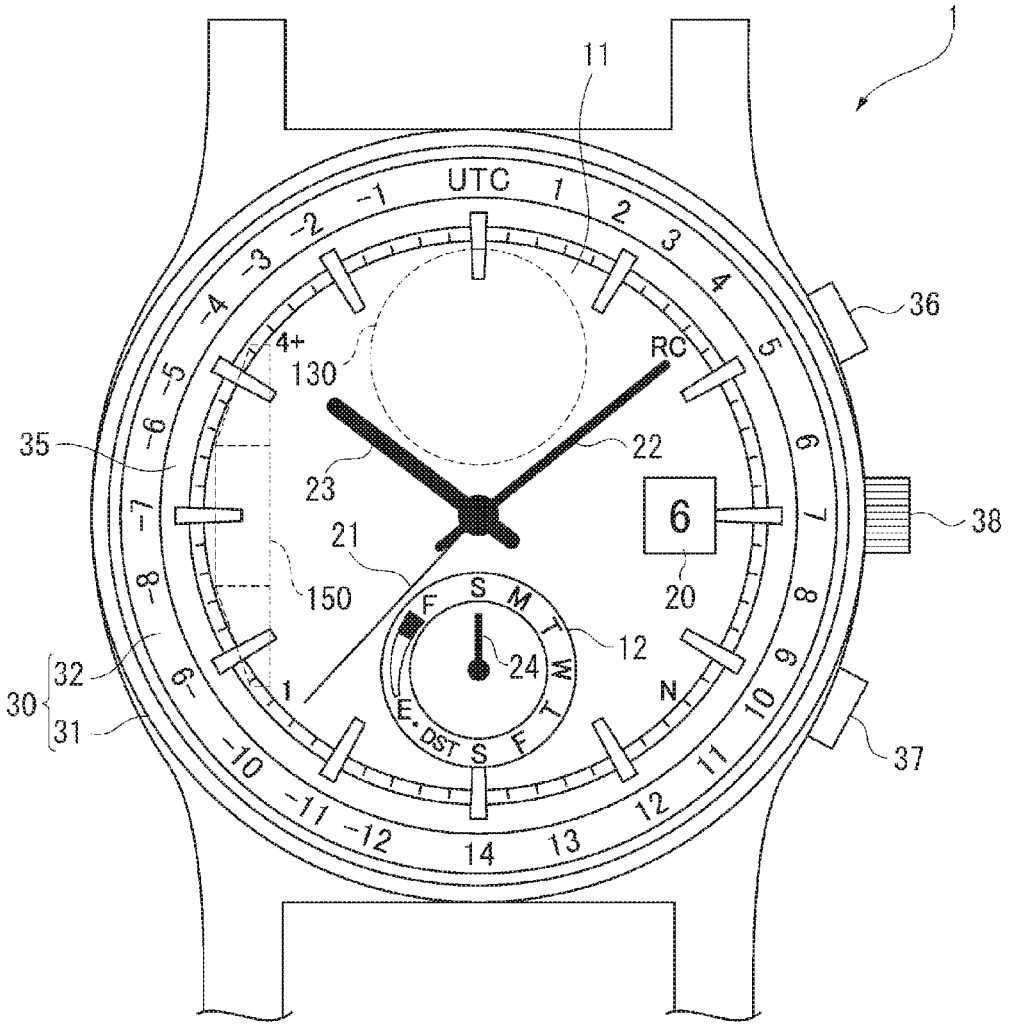
FIG. 2 shows the face of the electronic timepiece.
Figure 5:
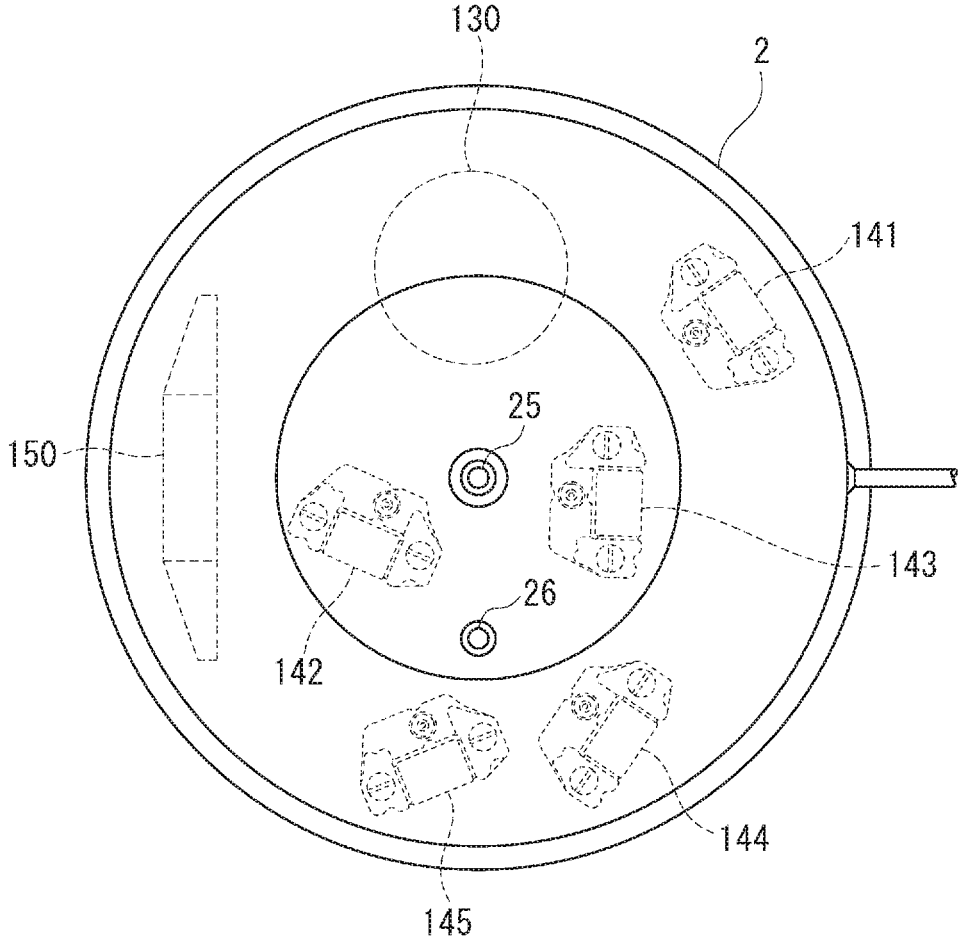
FIG. 5 shows the arrangement of the motors, battery, and bar antenna in the electronic timepiece.
Figure 6:
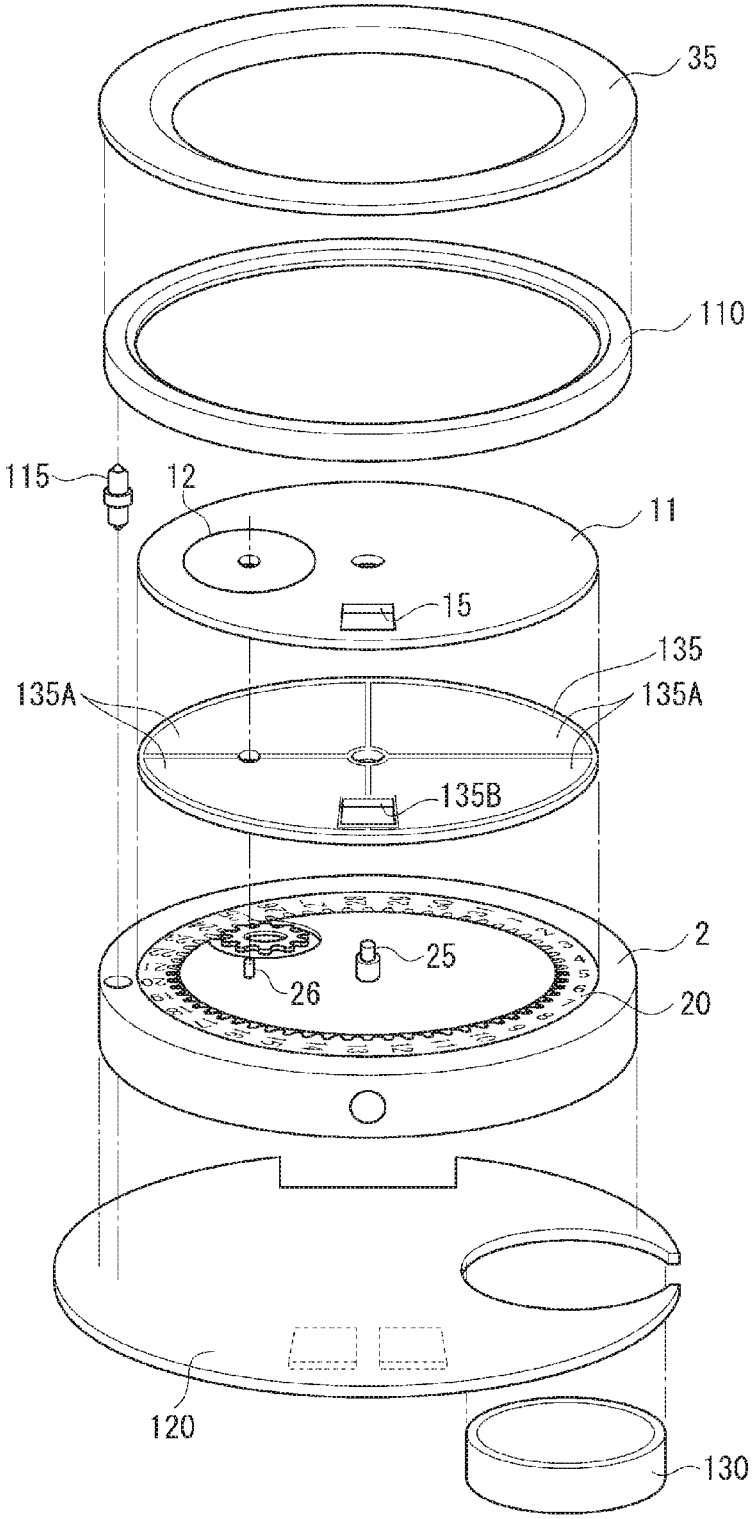
FIG. 6 is a partially exploded oblique view showing main parts of the electronic timepiece.

The configuration of an electronic timepiece 1 that can receive standard time signals and satellite signals is described next. FIG. 2 is a front view of the electronic timepiece 1, FIG. 3 is a section view of the electronic timepiece 1 through a line between 3:00 and 9:00 on the electronic timepiece 1, FIG. 4 is a section view through a line between 12:00 and 6:00 on the electronic timepiece 1, FIG. 5 is a plan view showing main parts of the electronic timepiece 1, and FIG. 6 is a partially exploded oblique view of the electronic timepiece 1.

The electronic timepiece 1 has an external case 30, crystal 33, and back cover 34. The external case 30 includes a ceramic bezel 32 affixed to a cylindrical metal case member 31. A round dial 11 is held inside the inside circumference of the bezel 32 by means of a plastic, ring-shaped dial ring 35.

Disposed around the center of the dial 11 in the side of the external case 30 are a button A 36, a button B 37, and a crown 38.

Figure 3:
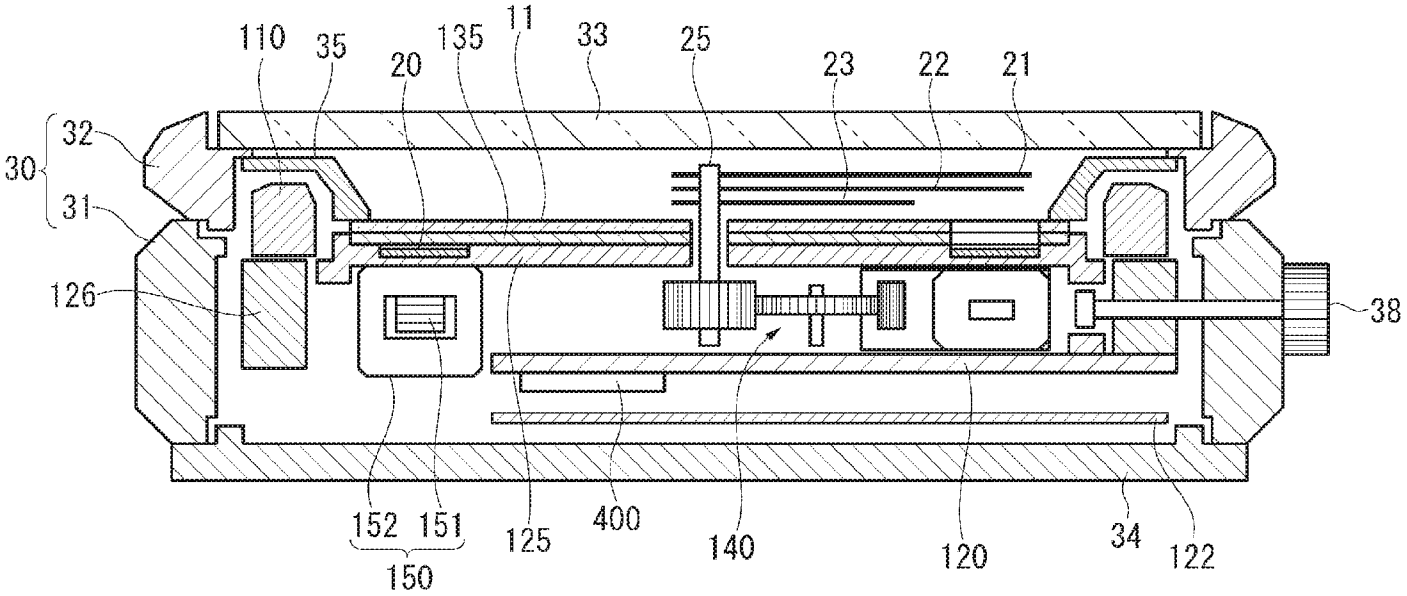
FIG. 3 is a section view of the electronic timepiece.
Figure 4:
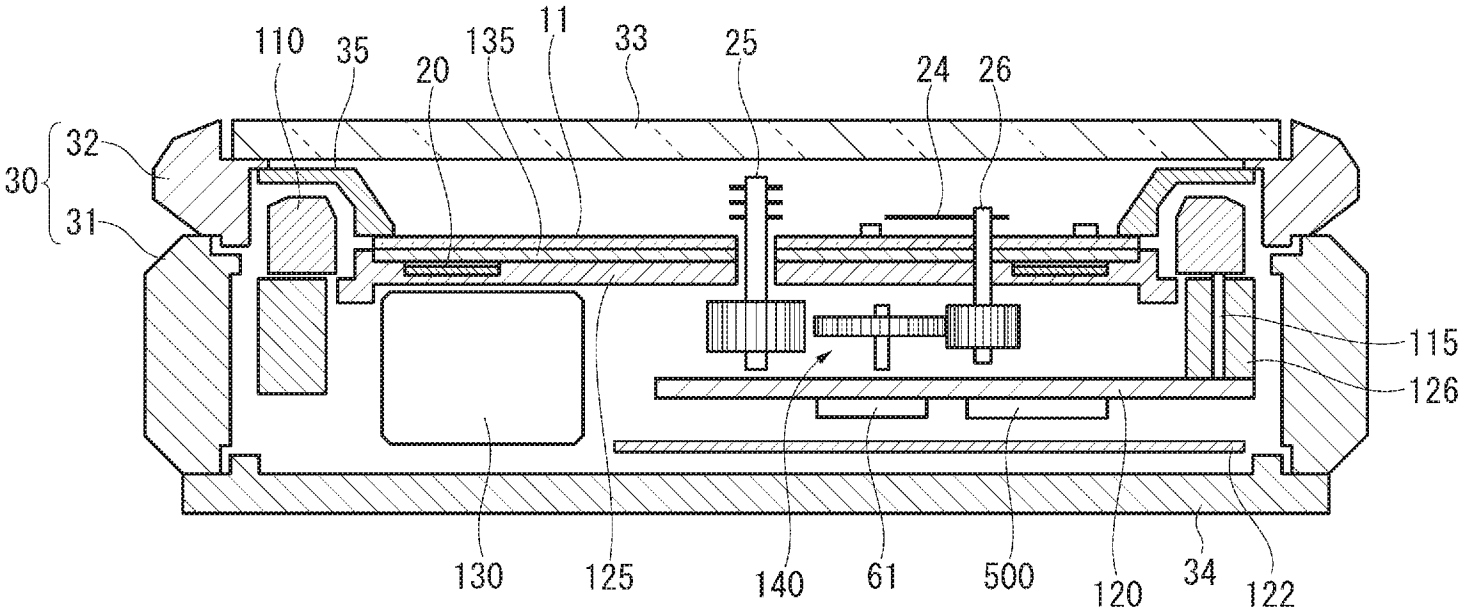
FIG. 4 is a section view of the electronic timepiece.

As shown in FIG. 3 and FIG. 4, of the two main openings in the case member 31, the opening on the face side is covered by the crystal 33 held by the bezel 32, and the opening on the back side is covered by the metal back cover 34. Note that the external case may be a single piece combining both the case member and back cover.

As shown in FIG. 6, the dial ring 35 attached to the inside circumference of the bezel 32, the optically transparent dial 11, a solar cell 135, a movement 2, a ring antenna 110, and a bar antenna 150 are disposed inside the external case 30.

As shown in FIG. 3 and FIG. 4, the movement 2 includes a main plate 125, a drive mechanism 140 supported by the main plate 125, a circuit board 120, a storage battery 130, and hands 21-24 and a date indicator (date indicator) 20 that are driven by the drive mechanism 140. Hands 21 to 23 are a second hand 21, minute hand 22, and hour hand 23 that turn on an arbor 25 disposed through the dial 11. Hand 24 is a hand that turns on a separate pivot 26 that passes through the dial 11.

The arbor 25 is disposed in the plane center of the dial 11, and pivot 26 is disposed on the 6:00 side of the arbor 25.

The drive mechanism 140 is disposed to the main plate 125, and is covered by a circuit board 120 from the back side. The drive mechanism 140 includes a stepper motor and wheel train, and drives the hands by the stepper motor rotationally driving the pivots through the wheel train.

As shown in FIG. 5, the drive mechanism 140 more specifically includes first to fifth drive mechanisms. The first drive mechanism includes a first wheel train (not shown in the figure) and a first stepper motor 141 that drives the hour hand 23. The second drive mechanism includes a second wheel train (not shown in the figure) and a second stepper motor 142 that drives the minute hand 22. The third drive mechanism includes a third wheel train (not shown in the figure) and third stepper motor 143 that drives the second-hand 21. The fourth drive mechanism includes a fourth wheel train (not shown in the figure) and a fourth stepper motor 144 that drives hand 24. The fifth drive mechanism includes a fifth wheel train (not shown in the figure) and fifth stepper motor 145 that drives the date indicator 20. Because this embodiment uses the ring antenna 110 as the antenna for receiving satellite signals, there is no need to provide space for a satellite signal antenna inside the movement 2, and more stepper motors can be included. As a result, the hands 21-24 and date indicator 20 can be independently driven, and the movement can be driven more quickly when fast-forwarding the hands, for example.

Note that the bar antenna 150 is disposed at the 9:00 position of the movement 2, and a lithium ion battery or other type of storage battery 130 is disposed to the 12:00 position. The pivot 26, hand 24, the fourth stepper motor 144 and fourth wheel train that drive the hand 24, and the fifth stepper motor 145 and fifth wheel train that drive the date indicator 20, are disposed at the 6:00 position of the movement 2. Space for the storage battery 130 therefore cannot be created at 6:00 in the movement 2. The storage battery 130 is therefore disposed to the 12:00 position of the movement 2 where space can be easily created in the electronic timepiece 1 according to this embodiment. More specifically, the diameter of the storage battery 130 is smaller than the radius of the dial 11, and can fit between the plane center of the dial 11 where the arbor 25 is located, and the outside edge of the dial 11 at 12:00. The storage battery 130 is further disposed between the 125 and the back cover 34 in the thickness direction of the electronic timepiece 1. The storage battery 130 is charged by power produced by the solar cell 135 as described below.

The dial ring 35 is shaped like a ring when seen in plan view, and is conically shaped when seen in section. A donut-shaped space is created by the dial ring 35 and the inside circumference surface of the bezel 32, the ring-shaped antenna 110 for receiving satellite signals is housed in this space.

Ring Antenna

The ring antenna 110 is disposed around the outside circumference of the dial 11 and is covered by the dial ring 35. The inside circumference surface of the dial ring 35 is tapered to improve the visibility of the dial 11, and the inside circumference surface of the ring antenna 110 is similarly tapered.

The ring antenna 110 has an annular antenna base, and an antenna element is formed on the surface of the antenna base. The antenna element is an electrode pattern embodied by electroless plating, a flexible printed circuit (FPC), or a silver paste positioning process, for example.

The antenna base is made of plastic due to its complex shape. In this case, a dielectric material that can be used at high frequencies, such as titanium oxide or ceramic, is mixed with the plastic to increase the dielectric constant. The frequency of satellite signals (GPS satellite signals) that are transmitted from the GPS satellites S is 1575.42 MHz, and one wavelength is approximately 19 cm. Because an antenna length of approximately 1.0 to 1.2 times the wavelength is required to receive circularly polarized GPS satellite signals, a loop antenna of approximately 19 to 24 cm is required to receive GPS satellite signals, which is difficult to fit inside a wristwatch.

This embodiment therefore uses the wavelength shortening effect of dielectric constant $\in r$ to enable receiving GPS satellite signals with a wristwatch ring antenna 110 approximately 3 cm in diameter. When an antenna base with dielectric constant $\in r$ is used, the wavelength shortening ratio is generally $(\in r)^{-1/2}$. In other words, by using a dielectric of dielectric constant $\in r$, the wavelength of signals received by the ring antenna 110 can be shortened, and a smaller ring antenna 110 can be used. To achieve the optimal wavelength shortening effect for receiving GPS satellite signals, the dielectric constant of the antenna base is ideally approximately 6 to 15.

To avoid interfering with GPS signal reception, the ring antenna 110 is covered by an ABS or other type of plastic dial ring 35, and markers for indicating the time are printed on the surface of the dial ring 35.

Because the outside circumference side of the ring antenna 110 is covered by the ceramic bezel 32 and the face side of the bezel 32 is covered by the crystal 33, there are no metal parts obstructing RF signals on the face side of the ring antenna 110. As a result, good reception performance can be assured in the ring antenna 110 used to receive satellite signals.

The ring antenna 110 is connected to the circuit board 120 through an antenna connection pin 115 on the 6:00 side of the dial 11. The antenna connection pin 115 is a spring-loaded feed pin, and as shown in FIG. 6 is inserted to a through-hole formed in the movement 2, and more specifically in the main plate bridge ring 126 as shown in FIG. 4. Product assembly is therefore improved because there is no need to solder or screw the ring antenna 110 and circuit board 120 together.

Bar Antenna

As shown in FIG. 3, the bar antenna 150 for receiving long-wave standard time signals is a bar antenna comprising an antenna core 151 and a coil 152 wound around the antenna core 151.

The antenna core 151 is made by, for example, stacking approximately 10 to 30 layers of an amorphous cobalt foil as a magnetic foil material on the antenna core 151 in the thickness direction of the electronic timepiece 1, and stabilizing the magnetic characteristics by annealing or other heat process.

The antenna core 151 has the coil winding where the coil 152 is wound, and leads extending from the opposite lengthwise ends of the coil winding. The leads are tapered and narrow from the base at the coil winding end to the distal ends of the antenna core 151.

Note that the antenna core 151 is not limited to a stacked amorphous foil configuration, and may be a soft magnetic metal ribbon. Further alternatively, while performance drops, a low cost ferrite antenna core 151 that can be molded with a die and heat treated may be used.

To receive long-wave standard time signals (40-77.5 kHz), the coil 152 wound to the winding part of the antenna core 151 requires inductance of approximately 20-100 mH. As a result, the coil 152 is made by winding several hundred turns of approximately 50 μm diameter polyurethane enameled copper wire.

A bar antenna 150 thus configured is disposed at 9:00 on the dial 11, and is screwed to the main plate 125. The coil 152 of the bar antenna 150 is conductive to the circuit board 120.

Circuit Board

The circuit board 120 is populated with a GPS receiver (GPS module) 500, standard time signal receiver circuit (standard time signal module) 400, and a controller (CPU) 61.

A circuit cover 122 is disposed below the circuit board 120. A magnetic shield not shown may be disposed between the circuit board 120 and circuit cover 122 to improve magnetic resistance.

Display Mechanism of the Electronic Timepiece

The hands 21, 22, 23 are disposed to an arbor 25 that passes through the front and back of the dial 11 in the plane center. Note that the center arbor 25 comprises three pivots (rotational pivots) to which the hands 21, 22, 23 are attached.

A scale of 60 minute markers is formed on the inside circumference side of the dial ring 35 around the outside edge of the dial 11. Using these markers, hand 21 indicates the second of the first time (the local time, such as the current local time when travelling abroad), hand 22 indicates the minute of the first time, and hand 23 indicates the hour of the first time.

The dial 11 also has markers used to indicate the reception result. More specifically, the letters RC indicating that standard time signal reception was successful are provided at the 8 second position of the dial 11; the symbol 4+ indicating that the positioning reception process was successful is provided at the 52 second position; and a 1 indicating that the timekeeping reception process was successful is provided at the 38 second position. The letter N indicating that the standard time signal reception process, positioning reception process, or the timekeeping reception process failed is provided at the 22 second position of the dial 11.

Note that the symbols and positions of these markers are not limited to the example shown in FIG. 2, and any markers enabling the user to know the reception mode may be used.

The subdial 12 (small hand indicator) is disposed at 6:00 on the dial 11. The letters S, M, T, W, T, F, S denoting the days of the week are provided on the right half of the subdial 12. The symbols DST indicating that daylight saving time is in effect, and a solid dot indicating that daylight saving time is not in effect, are provided around the 8:00 position (the 8:00 position of the hand 24 relative to the pivot 26) on the left side of the subdial 12. A sickle-shaped power reserve indicator between E (empty) and F (full) markers is also provided on the left side of the subdial 12. The information display comprising the subdial 12 and hand 24 (small hand) can indicate information including the timekeeping mode, day of the week, remaining battery capacity.

If the user pushes the button A 36 for less than 3 seconds, for example, in the operation to display the previous reception result, the second hand 21 moves rapidly and stops at the appropriate position, that is, RC, 4+, 1, or N. By checking the position indicated by the second hand 21, the user can know the content of the previous reception result and whether reception was successful or failed.

Simultaneously, the hand 24 indicates the power reserve left in the storage battery 130. More specifically, the hand 24 points to F if the storage battery 130 is still near full capacity, and points to E if the battery is low. If the charge of the storage battery 130 is at an intermediate level, the hand 24 points to a position on the scale corresponding to the battery capacity. The hand 24 points to a position in the black range near the F marker when the voltage level of the battery is sufficient to run the positioning reception process (a level at or above a second threshold described below).

If the user pushes button A 36 for 3 or more and less than 6 seconds to manually start the reception process in the timekeeping mode, the second hand 21 jumps to the 1 marker. If the user pushes button A 36 for 6 seconds or more to start reception in the positioning mode, the second hand 21 jumps to the 4+ marker. The user can thus know the reception mode and that reception is in progress.

Note that this embodiment does not have a manual reception mode for standard time signals, but if such a mode is provided, the user can know that standard time signal reception was manually started by the second hand 21 pointing to the RC marker.

This embodiment may also be configured so that the second hand 21 does not move to the RC marker, 1 marker, or 4+ marker indicating the corresponding reception mode when the reception process starts automatically. This is because the automated reception process often executes when the electronic timepiece 1 is set aside and the user does not look at the second hand 21. However, the user can also know the reception mode and progress during the automated reception process if the second hand 21 moves to the RC marker, 1 marker, or 4+ marker indicating the reception mode and that reception is in progress when reception starts automatically.

While reception starts manually in the positioning mode when the user pushes button A 36 for 6 seconds or more, this embodiment may also be configured to execute a leap second reception mode if the user continues pushing the button A 36 for a total of 10 seconds or more.

The time information received from GPS satellites is time information based on an atomic clock, and does not account for leap seconds. As a result, to correct the internal time of the electronic timepiece 1, UTC (Coordinated Universal Time) must be calculated by adding the current leap second value to the received time information. The current leap second information is stored on subframe 4, page 18 of the satellite signal, and is transmitted every 12.5 minutes. To acquire the leap second information in the leap second reception mode, reception must continue for a maximum 12.5 minutes. As a result, an LP marker denoting the leap second reception mode is preferably provided on the dial 11, and the second hand 21 points to this LP marker when the leap second reception mode is running. LP is a symbol denoting LeaP second, and may be provided between the 4+ marker and RC marker, or the LP marker may be provided instead of the RC marker.

If the operating mode can be switched between the timekeeping mode, positioning mode, and leap second reception mode according to how long the user pushes button A 36, the reception mode can be changed by the same operation of simply pushing button A 36. Leap second information is infrequently received, normally only once every several years. As a result, if a special operation must be performed to execute the leap second reception mode, remembering the necessary operation can be difficult. However, if the leap second reception mode is set based on how long the button A 36 is pushed, it is only necessary to change how long button A 36 is pushed, and usability can be greatly improved. Furthermore, because the second hand 21 indicates the selected reception mode, the user can reliably select the desired reception mode, and usability can be further improved.

The date window 15 is a rectangular opening in the dial 11 through which the date (numbers) printed on the date indicator 20 can be seen. The date indicator 20 displays the day value of the current date at the first time with the number that is visible through the date window 15.

Time difference information indicating the time difference to UTC (Coordinated Universal Time) is denoted by numbers around the inside circumference of the dial ring 35. Time difference information may also be indicated by numbers and non-numeric symbols.

City information denoting the name of a city located in the time zone that uses the standard time corresponding to the time difference indicated on the dial ring 35 may also be expressed beside the time difference information on the bezel 32 surrounding the dial ring 35. The city information is a three letter code abbreviating the name of the city with three alphabetic letters, such as TYO for Tokyo.

A solar cell 135, which is a photovoltaic power generator, is disposed between the dial 11 and a main plate 125.

As shown in FIG. 6, the solar cell 135 is a round flat solar panel having four solar cells 135A (photovoltaic devices) that convert light energy to electrical energy (power) connected in series. The solar cell 135 is substantially the same size as the dial 11.

Note that as described below, the solar cell 135 is also used to determine if the electronic timepiece 1 is outdoors or not by detecting sunlight as described below.

Through-holes through which the center arbor 25 of the hands 21, 22, 23 and the pivot 26 of hand 24 pass, and an aperture 135B and the date window 15 through which the date indicator 20 is exposed, are formed in the dial 11 and solar cell 135.

Circuit Configuration of the Electronic Timepiece

Figure 7:
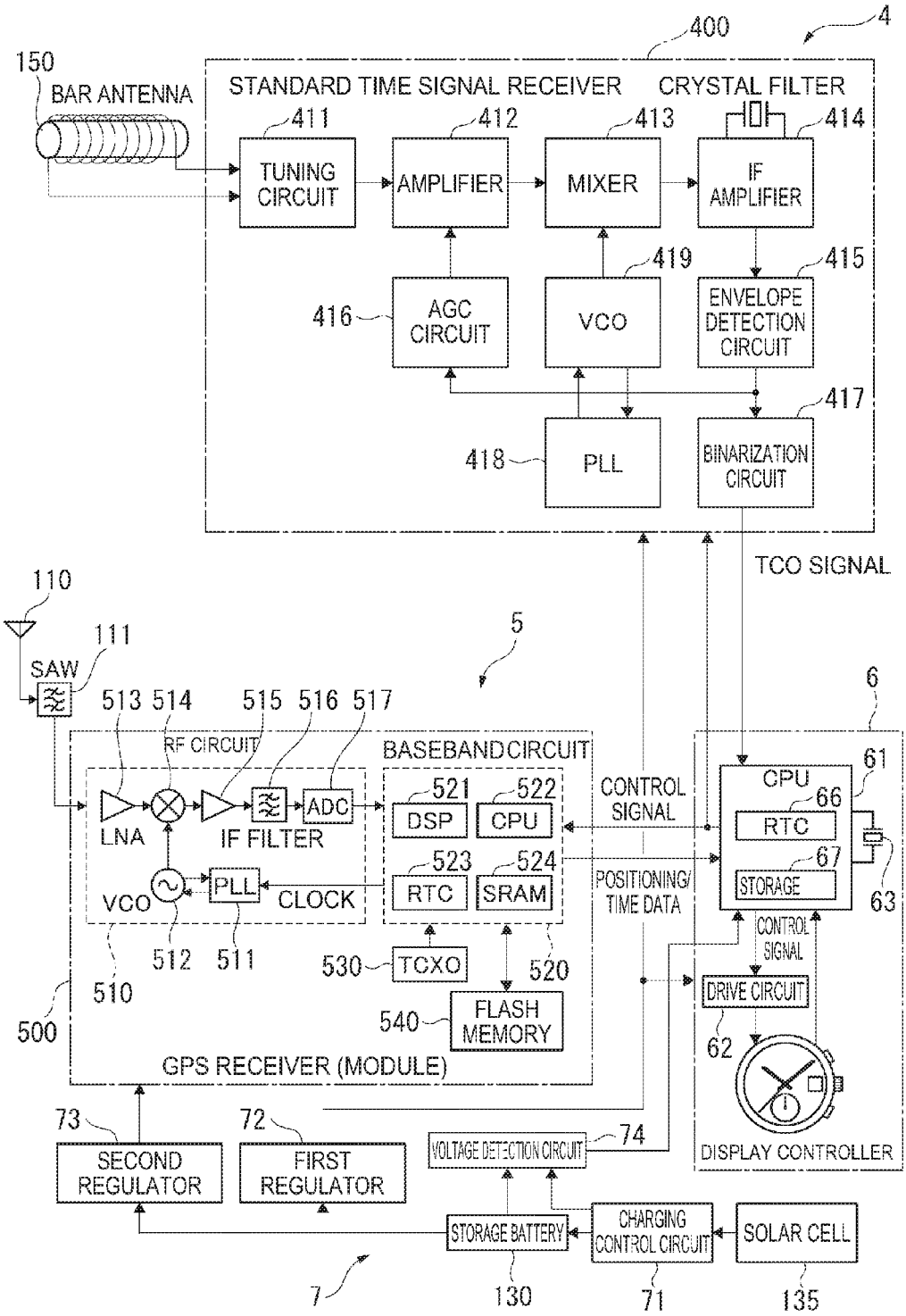
FIG. 7 is a block diagram illustrating the circuit design of the electronic timepiece.

FIG. 7 shows the basic circuit configuration of the electronic timepiece 1.

The main components of the electronic timepiece 1 include a standard time signal receiver 4 that receives long-wave standard time signal and acquires time information; a satellite signal receiver 5 that receives satellite signals and acquires time information; a display controller 6; and a power supply unit 7.

Figure 8:
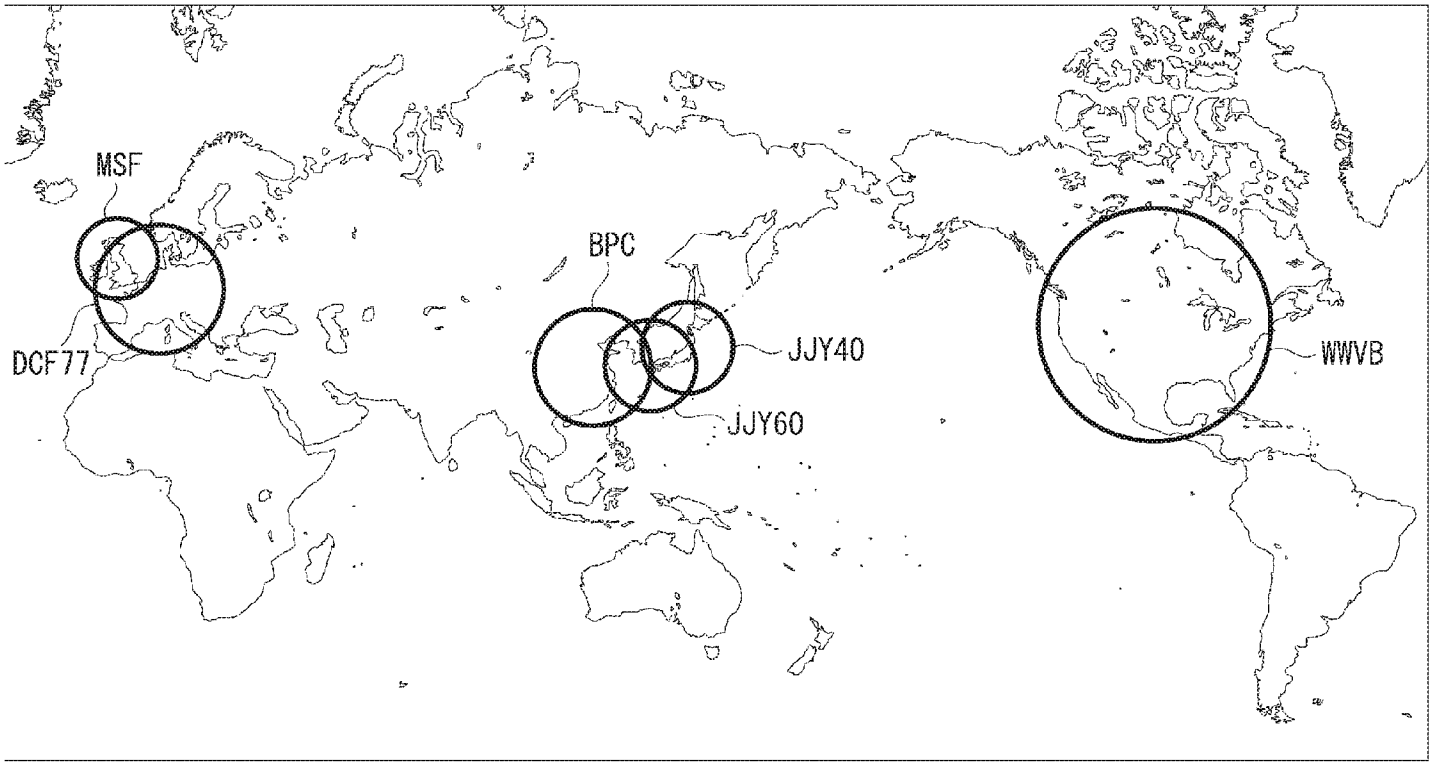
FIG. 8 illustrates standard time signal reception areas.

As shown in FIG. 8, long-wave standard time signals can only be received in specific areas of the world. More specifically, JJY40 and JJY60 can be received in areas centered on Japan; BPC can be received in an area centered on China, WWVB in an area centered on the United States, MSF in an area centered on Great Britain, and DVF77 in an area centered on Germany.

GPS satellite signals, however, can be received in an area significantly larger than the reception areas for long-wave standard time signals, that is, anywhere in the world.

Information related to the reception areas where long-wave standard time signals can be received is stored in the storage 67 described below.

Time Code Format of Long-Wave Standard Time Signals

The time information (time code) of a long-wave standard time signal is configured based on the time information format (time code format) specific to each country.

Figure 9:
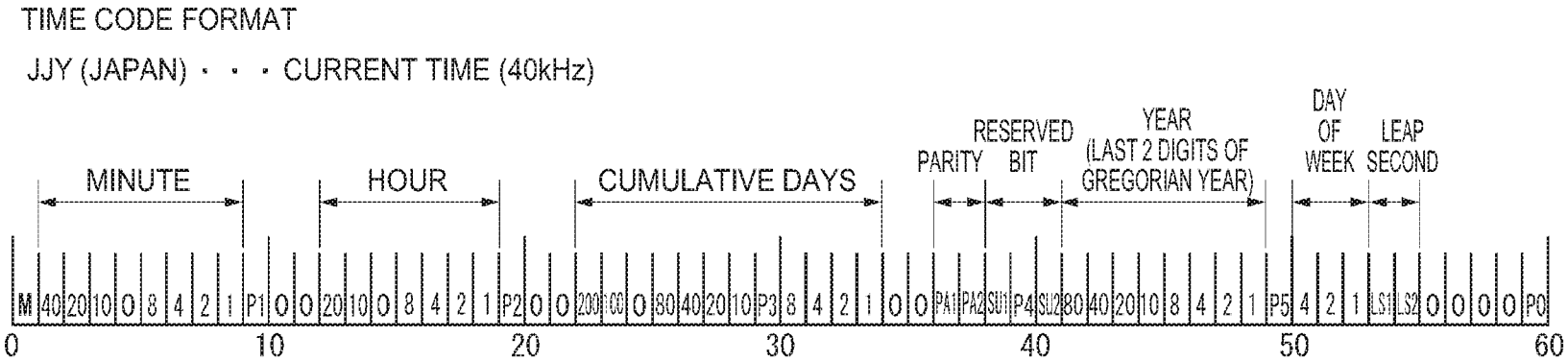
FIG. 9 shows the time code format of the JJY standard time signal.

For example, with the time code format of the JJY signal transmitted in Japan as shown in FIG. 9, one signal is transmitted each second, and it takes 60 seconds to transmit one record (one frame). In other words, one frame comprises 60 bits of data. The data fields contained in this time code format include the minute and hour of the current time, the cumulative number of days since January 1 of the current year, the year (denoted by the last two digits of the Gregorian calendar year), the day of the week, and the leap seconds. The value for each field is determined by combining the value assigned to each second (each bit), and the combination is determined from the type of signal. A parity bit PA1 corresponding to the hour, and a parity bit PA2 corresponding to the minute, are inserted between the bit train of the cumulative number of days and the bit train for the year. Note that M in FIG. 9 denotes the minute (0 second of each minute), and P1 to P5 are position marker signals, the positions of which are predefined.

The signal denoting a 1 in each field is a signal with a pulse width of approximately 0.5 second, signals denoting a 0 are signals with a pulse width of approximately 0.8 second, the P signals denoting the markers are signals with a pulse width of approximately 0.2 second.

The time code format of the standard time signal and the pulse widths (duty) of the various signals are set according to the type of long-wave standard time signal.

Navigation Data Message of the Satellite Signal

The navigation data message contained in the satellite signals sent from a GPS satellite and carrying the acquired information described above is described next. Note that the navigation data message is modulated at 50 bps onto the satellite signal carrier.

Figure 10A:
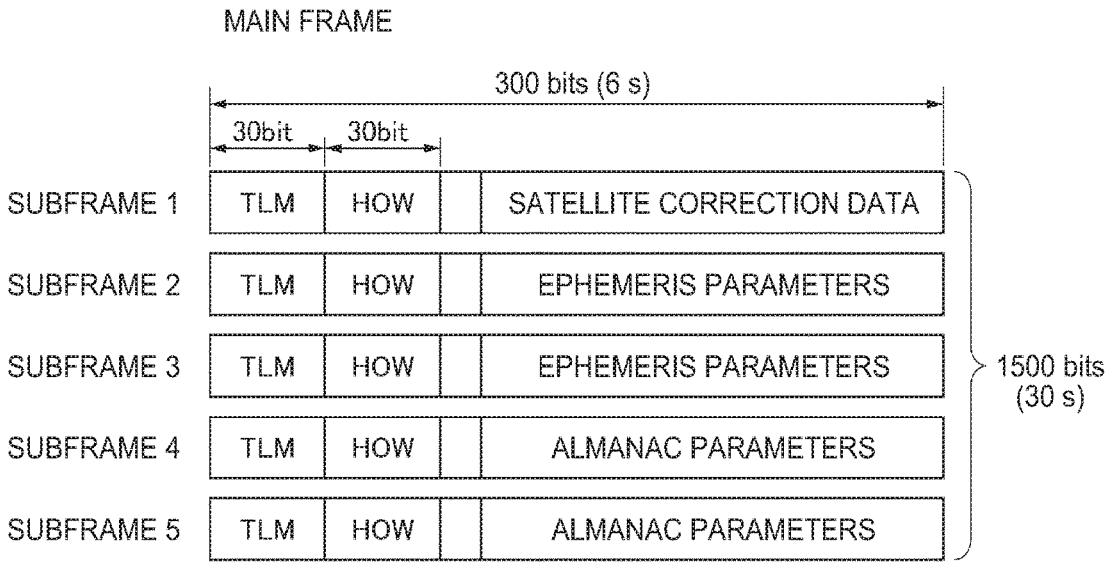
FIGS. 10A, 10B and 10C illustrate the configuration of a GPS satellite signal.
Figure 10B:
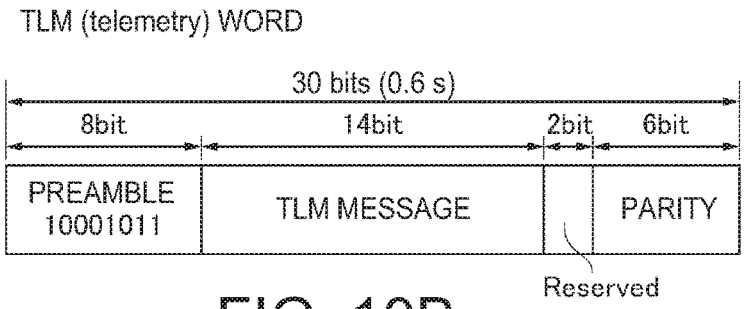
Figure 10C:
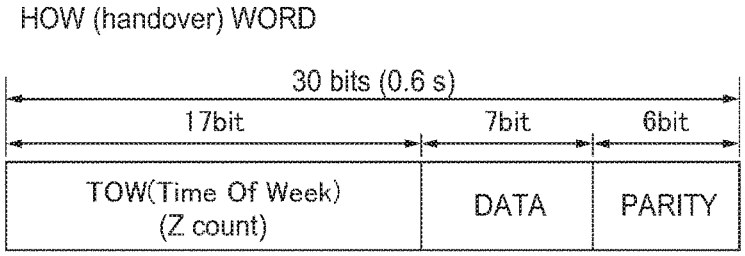

FIG. 10A to FIG. 10C describe the format of the navigation data message.

As shown in FIG. 10A, a navigation data message is composed of main frames each containing 1500 bits. Each main frame is divided into five subframes 1 to 5 of 300 bits each. The data in one subframe is transmitted in 6 seconds from each GPS satellite. It therefore takes 30 seconds for the data in one main frame to be transmitted from a GPS satellite.

Subframe 1 contains satellite correction data including week number data and SV health information. The week number identifies the week of the current GPS time information. More specifically, GPS time started at 00:00:00 on Jan. 6, 1980 in UTC, and the week number of the week that started that day is week number 0. The week number is updated every week. The SV health information is a code indicating satellite errors, and this code can be used to prevent using signals transmitted from satellites where there is an error.

Because subframes 1 to 3 in each set of five subframes contains information specific to a particular satellite, the same content is repeated during every transmission. More specifically, subframes 1 to 3 contain clock correction data and orbit information (ephemeris) specific to the transmitting satellite. Subframes 4 and 5, however, contain orbit information for all satellites (almanac data) and ionospheric correction information, which because of the large amount of information is divided into page units and stored in subframes 4 and 5 over pages 1 to 25. Because 25 frames are required to transmit the content of all pages, 12 minutes 30 seconds is required to receive all of the information in the navigation data message.

Each of subframes 1 to 5 starts with a telemetry (TLM) word storing 30 bits of telemetry data followed by a HOW word (handover word) storing 30 bits of handover data.

Therefore, while the TLM and HOW words are transmitted at 6-second intervals from the GPS satellites, the week number data and other satellite correction data, ephemeris, and almanac data are transmitted at 30-second intervals.

As shown in FIG. 10B, the TLM word contains a preamble, a TLM message and reserved bits, and parity data.

As shown in FIG. 10C, the HOW word contains GPS time information called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted.

For example, the Z count transmitted in subframe 1 denotes the GPS time that the first bit in subframe 2 is transmitted. The HOW word also contains 3 bits of data denoting the subframe ID (ID code). More specifically, the HOW words of subframes 1 to 5 shown in FIG. 10A contain the ID codes 001, 010, 011, 100, and 101, respectively.

Standard Time Signal Receiver

As shown in FIG. 7, the standard time signal receiver 4 includes the bar antenna 150 and standard time signal receiver circuit 400. The bar antenna 150 receives long-wave standard time signals (referred to below as a standard time signal), and outputs the received standard time signal to the standard time signal receiver circuit 400. The standard time signal receiver circuit 400 demodulates the standard time signal received by the bar antenna 150, and outputs the demodulated signal as a TCO (Time Code Output) signal to the controller 61 of the display controller 6.

The standard time signal receiver circuit 400 includes a tuning circuit 411, amplifier 412, mixer 413, an IF (intermediate frequency) amplifier 414 with a crystal filter, an envelope detection circuit 415, an AGC (Auto Gain Control) circuit 416, a binarization circuit 417, a PLL (phase locked loop) 418, and a VCO (Voltage Controlled Oscillator) 419. The standard time signal receiver circuit 400 is a common circuit for receiving standard time signals.

The tuning circuit 411 comprises a capacitor, and a parallel resonance circuit is embodied by the tuning circuit 411 and bar antenna 150. This tuning circuit 411 is configured so that JJY (JJY40 and JJY60), WWVB, DCF77, MSF, and BPC standard time signals can be selectively received.

Note that as described further below, when positioning information (latitude and longitude) for the electronic timepiece 1 is acquired by the satellite signal receiver 5, the controller 61 outputs a selection signal for the receiver station based on the positioning information to the standard time signal receiver circuit 400. The tuning circuit 411 of the standard time signal receiver circuit 400 then automatically selects the receiver station based on the control signal.

When positioning information for the electronic timepiece 1 has not been acquired by the satellite signal receiver 5, the appropriate receiver station can be selected by the user manipulating the crown 38 or other operating member to select the time zone (time difference).

The amplifier 412 adjusts the gain according to the signal (AGC voltage) input from the AGC circuit 416, and amplifies the reception signal input from the tuning circuit 411 to a specific amplitude, and inputs the amplified signal to the mixer 413.

The mixer 413 mixes the reception signal with a signal from the VCO 419, and down-converts to an intermediate frequency (IF).

The IF amplifier 414 further amplifies the reception signal input from the mixer 413, and outputs to the envelope detection circuit 415.

The envelope detection circuit 415 comprises a rectifier not shown and a low-pass filter (LPF) not shown, rectifies and filters the input reception signal, and outputs the filtered envelope signal to the AGC circuit 416 and binarization circuit 417.

Based on the envelope signal input from the envelope detection circuit 415, the AGC circuit 416 outputs a signal determining the gain used by the amplifier 412 to amplify the reception signal.

The binarization circuit 417 compares the envelope signal input from the envelope detection circuit 415 with a reference signal (threshold), and outputs a binarized signal, that is, a TCO signal.

Satellite Signal Receiver

The satellite signal receiver 5 includes the ring antenna 110, a filter (SAW) 111, and the GPS receiver 500 (reception module).

The SAW filter 111 is a bandpass filter that passes signals in the 1.5 GHz waveband. A LNA (low noise amplifier) may also be disposed between the ring antenna 110 and the filter 111 to improve reception sensitivity. Note also that the filter 111 may be embedded in the GPS receiver 500.

The GPS receiver 500 processes satellite signals passed through the filter 111, and includes an RF (radio frequency) circuit 510 and a baseband circuit 520.

The RF circuit 510 includes a PLL circuit 511, a VCO (voltage controlled oscillator) 512, a LNA (low noise amplifier) 513, a mixer 514, an IF amplifier 515, an IF filter 516, and an A/D converter 517.

A satellite signal passed by the filter 111 is amplified by the LNA 513, then mixed by the mixer 514 with the signal output by the VCO 512, and down-converted to a signal in the intermediate frequency band.

The IF signal from the mixer 514 is amplified by the IF amplifier 515, passed through the IF filter 516, and converted to a digital signal by the A/D converter 517.

The baseband circuit 520 includes a DSP (digital signal processor) 521, CPU (central processing unit) 522, a RTC (real-time clock) 523, and SRAM (static random access memory) 524. A TCXO (temperature compensated crystal oscillator) 530 and flash memory 540 are also connected to the baseband circuit 520.

A digital signal is input from the A/D converter 517 of the RF circuit 510 to the baseband circuit 520, which acquires satellite time information and navigation information by a correlation process and location computing process.

Note that the clock signal for the PLL circuit 511 is generated by the TCXO 530.

A time difference (time zone) database relating location information (latitude and longitude) to time difference (time zone) information is stored in flash memory 540. Therefore, if the location can be calculated by receiving satellite signals, the time difference (time zone) at the received location can be detected and set based on the latitude and longitude data and the time difference database. Note that an EEPROM (electrically erasable programmable read-only memory) device may be used instead of flash memory 540.

Note that while the time zone database is stored in the flash memory 540 of the GPS receiver 500 in this embodiment, nonvolatile memory such as EEPROM or flash memory may be provided in the controller 61 of the display controller 6, and the time difference database stored in this nonvolatile memory device.

Display Controller

The display controller 6 includes a controller (CPU) 61, a drive circuit 62 that drives the hands 21-24, a crystal oscillator 63, a time display, and an information display.

The controller 61 includes a RTC 66 and storage 67.

The RTC 66 keeps the internal time using a reference signal output from a crystal oscillator 63.

The storage 67 stores the satellite time information and positioning information output from the GPS receiver 500, and the TCO (time information of the standard time signal) output from the standard time signal receiver circuit 400.

The controller 61 switches between the standard time signal receiver 4 and satellite signal receiver 5 by outputting control signals to the standard time signal receiver 4 and satellite signal receiver 5. GPS satellite signals have a higher frequency than standard time signals at approximately 1.5 GHz, and the strength of the reception signal is approximately 1/100. As a result, the GPS satellite signal reception process of the satellite signal receiver 5 requires approximately 500 times as much power as the standard time signal reception process of the standard time signal receiver 4. The controller 61 therefore switches between the standard time signal receiver 4 and satellite signal receiver 5 instead of driving them simultaneously.

By having a standard time signal receiver 4, satellite signal receiver 5, and display controller 6 as described above, the electronic timepiece 1 according to this embodiment can automatically correct the time information based on the standard time signal received from a standard time signal transmitter R, and can automatically correct the displayed time based on the satellite signals from the GPS satellites S.

Power Supply Unit

The power supply unit 7 includes the solar cell 135, a charging control circuit 71, the storage battery 130, a first regulator 72, a second regulator 73, and a voltage detection circuit 74.

When light is incident and the solar cell 135 produces power, the power obtained by photovoltaic generation is passed by the charging control circuit 71 to the storage battery 130 to charge the storage battery 130. The solar cell 135 therefore embodies the power generator.

The storage battery 130 supplies drive power through the first regulator 72 to the display controller 6 and the standard time signal receiver circuit 400, and supplies power through the second regulator 73 to the GPS receiver 500. The storage battery 130 therefore embodies a power supply that supplies drive power.

The voltage detection circuit 74 monitors the output voltage of the storage battery 130, and outputs to the controller 61. The voltage detection circuit 74 therefore embodies a reserve power detector that detects how much power remains in the storage battery 130 embodying the power supply. Because the battery voltage detected by the voltage detection circuit 74 is input to the controller 61, the controller 61 can know the voltage of the storage battery 130 and control the reception process appropriately.

When the solar cell 135 and storage battery 130 are disconnected as controlled by the controller 61, the charging control circuit 71 can control detecting the voltage of the solar cell 135 by the voltage detection circuit 74. In this event, the voltage detection circuit 74 can detect the output voltage (power output) of the solar cell 135 without affecting the voltage of the storage battery 130. The voltage detection circuit 74 therefore embodies a power generation detector that detects the power output of the solar cell 135, and inputs the detected power output to the controller 61. As a result, the controller 61 can determine whether or not the electronic timepiece 1 is outdoors based on the power output of the solar cell 135.

Controller Configuration

Figure 11:
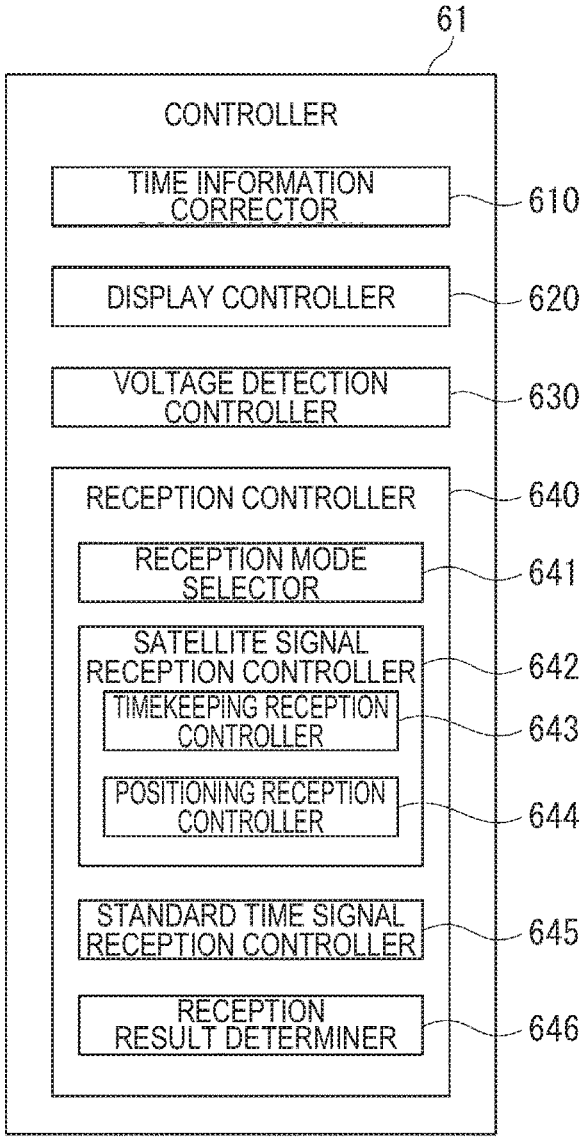
FIG. 11 is a block diagram showing the configuration of the controller of the electronic timepiece.

The configuration of the controller 61 is described next with reference to FIG. 11. FIG. 11 illustrates the function blocks that are embodied by a program executed by the controller 61.

The controller 61 includes a time information corrector 610, display controller 620, voltage detection controller 630, and a reception controller 640.

The time information corrector 610 corrects the internal time information using the time information received by the standard time signal receiver 4 or satellite signal receiver 5.

In the normal operating mode, the display controller 620 controls the drive circuit 62 based on the internal time information to display the time (hour, minute, second) with the hands 21 to 23. The display controller 620 also controls the drive circuit 62 based on the internal time information to indicate the day of the week (Sunday to Saturday) with hand 24. The display controller 620 also controls the information indicated by the hands 21-24 appropriately to the reception control state.

The voltage detection controller 630 operates the voltage detection circuit 74 to detect the voltage, that is, the remaining battery capacity, of the storage battery 130, and the power output of the solar cell 135. The voltage detection controller 630 operates the voltage detection circuit 74 and detects the battery voltage at a specific time interval. The voltage detection controller 630 also controls operation of the charging control circuit 71.

Reception Controller

The reception controller 640 includes a reception mode selector 641, a satellite signal reception controller 642, a standard time signal reception controller 645, and a reception result detector 646. The satellite signal reception controller 642 includes a timekeeping reception controller 643, and a positioning reception controller 644.

The reception mode selector 641 determines if the button A 36 was operated to start reception, or if a predetermined automatic reception condition was met, and selects the satellite signal reception mode (timekeeping mode or positioning mode) or the standard time signal reception mode. The reception mode selector 641 selects the timekeeping mode if button A 36 is pressed for a first specific time (such as 3 or more and less than 6 seconds), and selects the positioning mode if button A 36 is pressed for a second specific time (such as 6 seconds or more). If the voltage detection circuit 74 detects that the electronic timepiece 1 is outdoors and an automatic reception condition is met, the reception mode selector 641 normally selects the timekeeping mode, and selects the positioning mode only once after the reception-off mode of the electronic timepiece 1 is cancelled.

The satellite signal reception controller 642 is operated when the satellite signal reception mode is selected by the reception mode selector 641.

If the timekeeping mode is selected, the satellite signal reception controller 642 operates the timekeeping reception controller 643, and the timekeeping reception controller 643 controls the satellite signal receiver 5 to execute the timekeeping reception process.

If the positioning mode is selected, the satellite signal reception controller 642 operates the positioning reception controller 644, and the positioning reception controller 644 controls the satellite signal receiver 5 to execute the positioning reception process.

The standard time signal reception controller 645 is operated when the standard time signal reception mode is selected by the reception mode selector 641. The standard time signal reception controller 645 controls the standard time signal receiver 4 to execute the standard time signal reception process.

The reception result determiner 646 determines if the timekeeping reception process of the timekeeping reception controller 643, the positioning reception process of the positioning reception controller 644, or the standard time signal reception process of the standard time signal reception controller 645 was successful.

For example, in the timekeeping reception process, the reception result determiner 646 compares the time information (Z count) acquired from the received satellite signal and the time data of the RTC 66 match. If the difference therebetween is great, the reception result determiner 646 may compare the Z count with the Z count received in the next subframe to prevent correction errors, and if multiple satellites are locked onto, the reception result determiner 646 may compare the Z counts from the plural satellites to determine if the acquired time data matches. If the reception result determiner 646 determines the times match, the time information corrector 610 corrects the time.

Automatic Reception Process

The automatic reception process, which is a reception process executed when a predetermined automatic reception condition is met, in this embodiment is described next with reference to FIG. 12 to FIG. 16.

Figure 12:
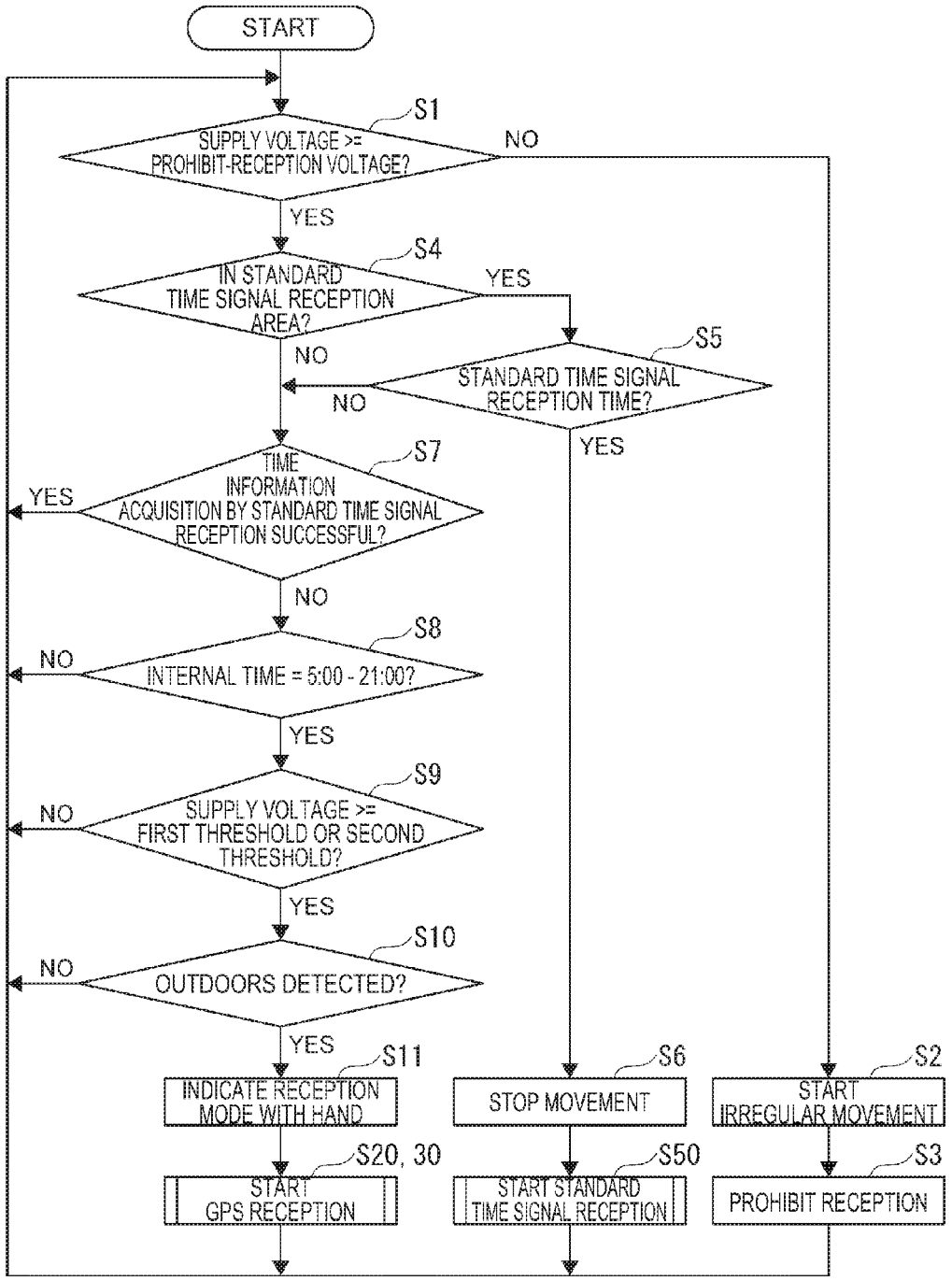
FIG. 12 is a flow chart of the automated reception process in this embodiment.

When the electronic timepiece 1 is not set to a mode that blocks executing the automatic reception process, such as an airplane mode, the controller 61 executes the process shown in FIG. 12.

Figure 16:
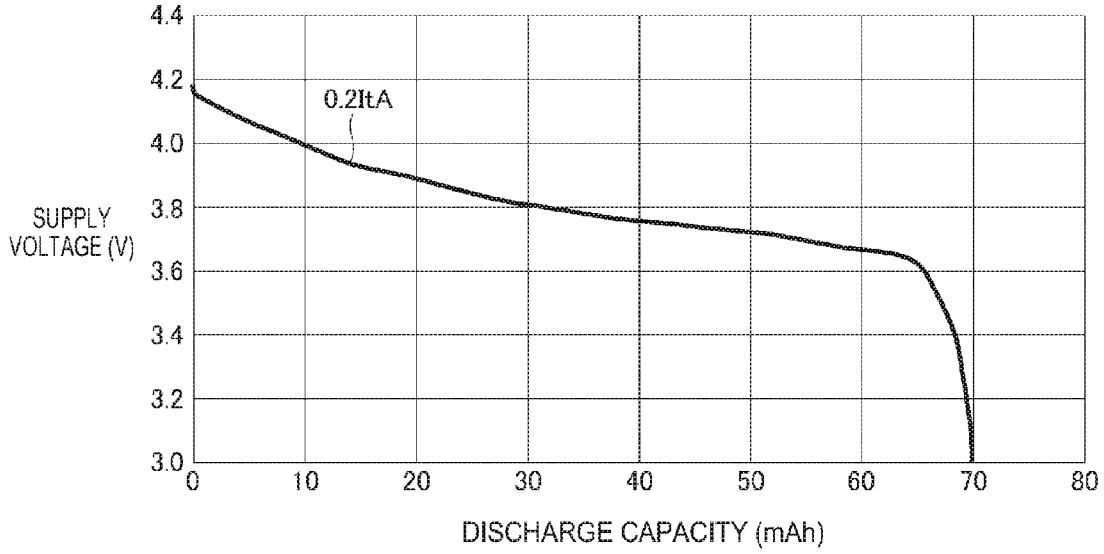
FIG. 16 is a graph of the relationship between the discharge capacity and battery voltage of the storage battery.

The relationship between battery voltage and discharge capacity (remaining battery capacity, power reserve) is shown in FIG. 16. This embodiment uses a lithium ion battery as the storage battery 130, and FIG. 16 shows the discharge voltage characteristic thereof. As will be understood from the relationship between the battery voltage and the discharge capacity shown in the graph in FIG. 16, the power reserve (storage capacity) of the storage battery 130 can be known by measuring the battery voltage of the storage battery 130.

The voltage detection circuit 74 operates at a specific interval, such as 60 seconds, as controlled by the voltage detection controller 630. Because the voltage detection circuit 74 detects the battery voltage every 60 seconds, the controller 61 always knows the remaining capacity of the storage battery 130.

The voltage detection controller 630 sets the battery voltage of the storage battery 130 at which the controller 61 may shut down if the standard time signal reception process, which consumes less current than the GPS satellite signal reception process, is executed as the prohibit-reception voltage. The voltage detection controller 630 also sets the voltage at which the controller 61 will not shut down if the timekeeping reception process of GPS satellite signals, which consumes more current than the standard time signal reception process, is executed as a first threshold, and sets the voltage at which the controller 61 will not shut down if the positioning reception process, which consumes more current than the timekeeping reception process, is executed as a second threshold.

The prohibit-reception voltage is set to 3.4 V, for example, for a storage battery 130 with a discharge characteristic as shown in FIG. 16. In addition, the first threshold is 3.5 V, and the second threshold is 3.6 V. In the graph in FIG. 8, the discharge capacity is approximately 80% of full capacity when the battery voltage is 3.6 V, and approximately 99% of full capacity when the battery voltage is 3.4 V. The prohibit-reception voltage and the first and second threshold voltages may be set based on the discharge characteristic of the storage battery 130.

Note that this embodiment detects the power reserve of the storage battery 130 by detecting the battery voltage of the storage battery 130, but the remaining battery capacity may be detected more accurately by adding a means of detecting the charge/discharge current of the storage battery 130, and using a combination of the charge/discharge current and the battery voltage to decide.

Referring again to FIG. 12, the controller 61 detects the battery voltage of the storage battery 130 every 60 seconds by means of the voltage detection circuit 74, which is a reserve power detector, and determines if the battery voltage is greater than or equal to the previously set prohibit-reception voltage (S1).

If the battery voltage is less than the prohibit-reception voltage and S1 returns NO, the controller 61 starts irregular movement of the hands by the drive circuit 62 (S2), and maintains a reception-prohibited state (S3). This irregular movement (or BLD movement) drives the hands in a mode different from the normal timekeeping mode, such as advancing the second hand 21 in 2-second increments every two seconds, in what is also referred to as a Battery Low display (BLD) or battery life indicator function. This enables the user to know that the voltage of the storage battery 130 is low and expose the solar cell 135 to light to charge the storage battery 130.

During irregular movement of the hands, the controller 61 repeats step S1 to check the battery voltage with the voltage detection circuit 74 at a regular interval, such as a 1-second interval. The controller 61 then repeats the irregular movement of step S2 and the reception-prohibited state of step S3 until S1 returns YES.

If the battery voltage is greater than or equal to than the prohibit-reception voltage and S1 returns YES, the controller 61 determines if the current location of the electronic timepiece 1 is within a standard time signal reception area (S4). More specifically, if the positioning information (latitude and longitude) acquired by the positioning reception process and information indicating standard time signal reception areas are stored in the storage 67, and the positioning information is within any standard time signal reception area, the controller 61 returns YES in S4. The controller 61 also returns YES in S4 if time zone data set by the user manipulating the crown 38, for example, is stored in the storage 67 and this time zone data is within an standard time signal reception area.

If S4 returns YES, the controller 61 determines if the internal time (current time) kept by the controller 61 is a previously set scheduled standard time signal reception time (S5). The scheduled standard time signal reception time is set to a time when there is little noise, such as 2:00 a.m. Plural scheduled standard time signal reception times may also be set, such as at 2:00, 3:00, and 4:00 a.m. In this event, if the reception process fails at 2:00 a.m., the reception process repeats at 3:00 a.m., and if the reception process fails at 3:00 a.m., the reception process repeats at 4:00 a.m.

If the internal time has reached a scheduled standard time signal reception time, the controller 61 returns YES in S5. In this event, the controller 61 stops movement of the hands 21-24 by the drive circuit 62 (S6). That standard time signal reception is in progress may be displayed in this event by stopping the second hand 21 at the RC marker at the 8-second position.

Next, the controller 61 starts the standard time signal reception process (S50). This standard time signal reception process is described further below.

If the current location or the time zone data set by the user is outside a standard time signal reception area (S4 returned NO), or if the location is within a standard time signal reception area but a scheduled reception time has not been reached (S5 returned NO), the controller 61 determines if the standard time signal was received at the last scheduled reception time and acquisition of time information was successful, or if acquisition was not successful (S7).

If the standard time signal was received, acquisition of time information was successful, and step S7 returned YES, the controller 61 returns to step S1 because there is no need to receive GPS satellite signals. As a result, if the standard time signal was received and time information acquisition was successful at the scheduled standard time signal reception time at 2:00 a.m., for example, the GPS satellite signal reception process is not executed until the scheduled standard time signal reception time the next day. Therefore, if the standard time signal is received and time information acquisition is successful at the scheduled standard time signal reception time every day, the standard time signal reception process is prioritized and the GPS satellite signal reception process is not executed.

However, if at the scheduled standard time signal reception time the standard time signal reception process is not executed (S4 returns NO), or if acquisition of time information by receiving a standard time signal failed, such as if the reception process was executed but the standard time signal could not be received, or if the standard time signal was received but acquisition of time information failed, the controller 61 returns NO in S7 and goes to step S8. Therefore, if daily reception of the standard time signal fails, the GPS satellite signal reception process executes if the conditions defined by steps S8 to S10 are satisfied.

If S7 returns NO, the controller 61 determines if the internal time is from 5:00 to 21:00 (S8). S8 determines is the current time is not night (21:00 to 5:00) when the sun is not out.

If S8 returns YES, the controller 61 determines if the battery voltage detected by the voltage detection circuit 74 is greater than or equal to the first threshold or the second threshold (S9). That is, if the reception process is being executed by the timekeeping reception controller 643, the controller 61 determines if the battery voltage is greater than or equal to the first threshold (S9). If the reception process is being executed by the positioning reception controller 644, the controller 61 determines if the battery voltage is greater than or equal to the second threshold (S9).

If S9 returns YES, the controller 61 determines if outdoor detection is successful (S10). Outdoor detection determines if the solar cell 135 is exposed to sunlight. As a result, the controller 61 regularly controls the charging control circuit 71 to interrupt the charging path between the solar cell 135 and storage battery 130, then detects the voltage of the solar cell 135 with the voltage detection circuit 74, and detects being outdoors if the voltage of the solar cell 135 is greater than or equal to a specific voltage.

If NO is returned by any of steps S8 to S10, the controller 61 returns to S1. If steps S8 to S10 each return YES, the controller 61 moves the second hand 21 to the 1 marker, or to the 4+ marker if the positioning mode was selected immediately after cancelling the airplane mode, to indicate that GPS satellite signals are being received (S11).

Next, the controller 61 starts the GPS satellite signal reception process (S20, S30). More specifically, if the internal time is between 5:00 and 21:00, that is, it is not night when the sun is not out (S8 returns YES), the battery voltage is greater than or equal to the first threshold (3.5 V) or the second threshold (3.6 V), and outdoor detection was successful, the controller 61 normally executes the timekeeping reception process (S20), and executes the positioning reception process (S30) only once after the airplane mode is cancelled.

Timekeeping Reception Process

Figure 13:
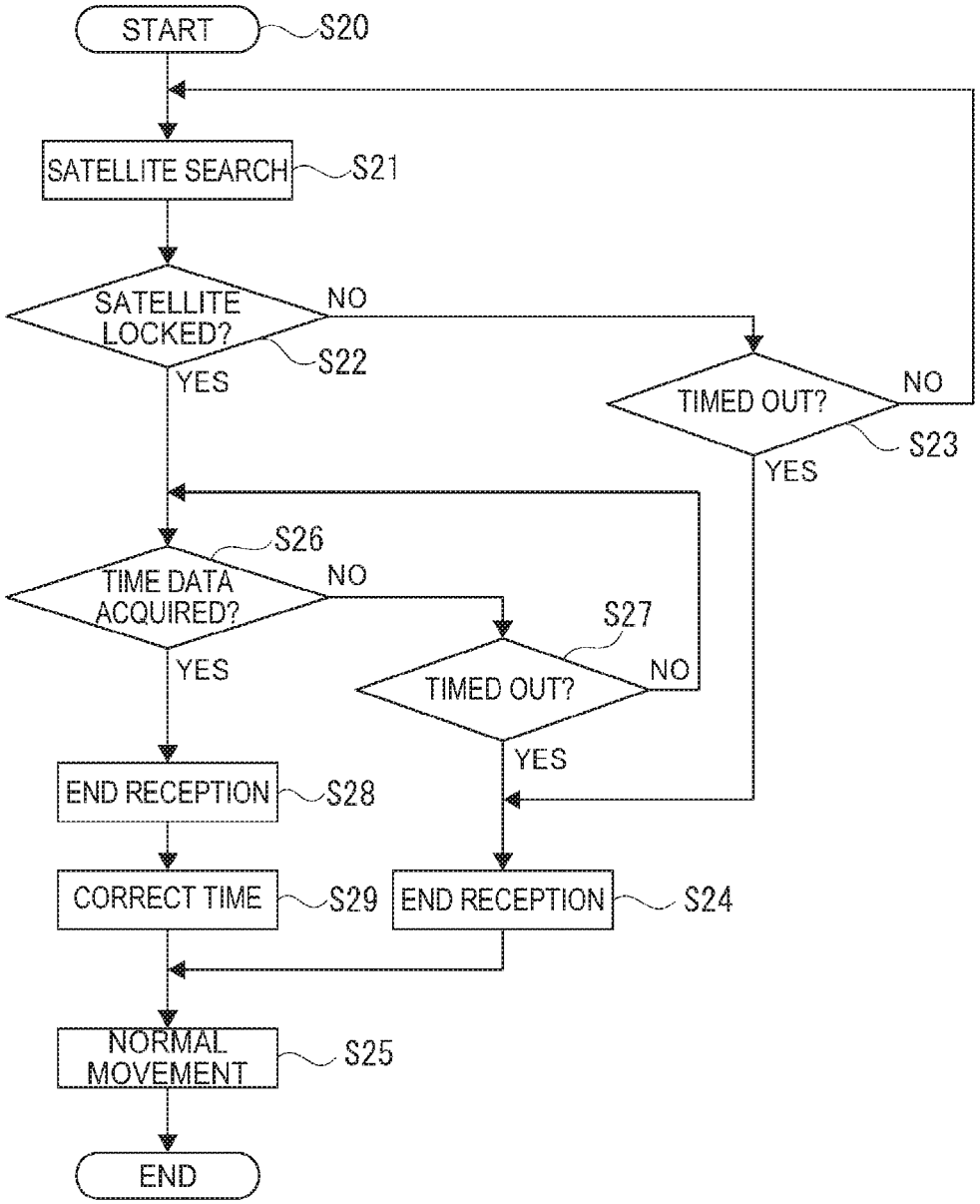
FIG. 13 is a flowchart of the timekeeping reception process in this embodiment.

The timekeeping reception process (S20) shown in FIG. 13 is described next. The process in FIG. 13 is executed in this embodiment when the reception mode is indicated by the second hand 21 in S11.

The timekeeping reception controller 643 starts a satellite search (S21). Next, the timekeeping reception controller 643 determines if a satellite was locked onto (S22). If S22 returns NO because a satellite cannot be locked, the timekeeping reception controller 643 determines if the time passed since timekeeping reception started has reached a specific timeout time (such as 1 to 2 minutes) (S23).

If the timeout time was passed in S23 and operating timed out (S23 returns YES), the timekeeping reception controller 643 stops reception (S24), and the controller 61 resumes normal operation of the movement (S25).

However, if operation did not time out in S23 (S23 returns NO), the timekeeping reception controller 643 continues the satellite search process of S21.

If a satellite was locked onto in S22 (S22 returns YES), the timekeeping reception controller 643 determines if the time data (Z count) was acquired (S26). Note that if plural satellites are locked, time data may be acquired from the satellite signal with the highest signal strength (SNR), or time data may be acquired from plural satellites, the coherence of the time data checked, and the success of time data acquisition determined.

If S26 returns NO, the timekeeping reception controller 643 determines if a specific timeout time (such as 30 seconds) has passed (S27).

If S27 returns NO, the timekeeping reception controller 643 repeats S26. Because the Z count can be received at a 6-second interval from a GPS satellite signal, the Z count can be received five times before operation times out if the timeout time in S27 is set to 30 seconds.

If operation times out in S27 (S27 returns YES), the timekeeping reception controller 643 ends the reception process (S24), and resumes normal operation of the movement (S25).

However, if S26 returns YES, the timekeeping reception controller 643 ends reception (S28), and the time information corrector 610 corrects the time information based on the acquired time data (S29). When the time information corrector 610 corrects the time information, the display controller 620 adjusts the time indicated by the second hand 21, minute hand 22, and hour hand 23 through the drive circuit 62 based on the corrected time information, and then resumes normal operation of the movement (S25).

The timekeeping reception process executed when an automatic reception condition is met thus ends. When the timekeeping reception process ends, the controller 61 returns to S1 in FIG. 12 and continues the process.

Positioning Reception Process

The positioning reception process S30 is described next with reference to FIG. 14.

When the positioning reception process S30 starts, the display controller 620 indicates with the second hand 21 that the positioning reception process is executing (S31). More specifically, the display controller 620 sets the second hand 21 to the 4+ marker at the 52-second position on the dial 11 during the positioning reception process. In addition, the positioning reception controller 644 outputs a control signal to the GPS receiver 500 to start the positioning reception process (S31).

When starting the positioning reception process is instructed, the GPS receiver 500 (baseband circuit 520) starts the satellite search process (S32).

The GPS receiver 500 determines a GPS satellite S was received in the satellite search process if the satellite signal reception level is greater than or equal to a specific level.

The GPS receiver 500 also determines if satellite signals were received from at least the specific number of satellites required for positioning (at least 3 and normally 4) (S33).

If S33 returns NO, the GPS receiver 500 determines if the timeout period for the satellite search has passed (S34). The timeout time for the satellite search process is, for example, 15 seconds.

If S34 returns NO, the GPS receiver 500 continues the satellite search process of S32.

If S34 returns YES, the GPS receiver 500 ends the satellite search process (S35), and the controller 61 resumes normal operation of the movement (S36). This is to avoid continuing the reception process and unnecessarily consuming power from the storage battery 130 because the electronic timepiece 1 is in an environment where a GPS satellite S lock is not possible.

If S33 returns YES, the GPS receiver 500 determines if satellite orbit data (ephemeris) was acquired from the locked satellite signal (S37).

If S37 returns YES, the GPS receiver 500 calculates the location based on the acquired satellite orbit data, and determines if the positioning calculation was completed (S38).

If NO is returned by S37 or S38, the GPS receiver 500 determines if the timeout period for the positioning calculation has passed (S39). This positioning calculation timeout period is 120 seconds, for example.

If operation has timed out in S39 (S39 returns YES), the GPS receiver 500 ends the reception process (S35), and the controller 61 resumes normal operation of the movement (S36).

However, if operation has not timed out in S39 (S39 returns NO), the GPS receiver 500 returns to S37 and continues the process.

If S38 returns YES, the GPS receiver 500 ends the reception process (S40), reads the time difference information corresponding to the location information determined from the positioning calculation, from the time difference database stored in flash memory 540, and outputs to the controller 61 (S41).

The time information corrector 610 of the controller 61 then corrects the time information using the time difference information output from the GPS receiver 500, and the display controller 620 displays the corrected time with the second hand 21, minute hand 22, and hour hand 23 (S42). Next, the controller 61 resumes normal operation of the movement (S36).

The positioning reception process executed when an automatic reception condition is met thus ends. When the positioning reception process ends, the controller 61 returns to S1 in FIG. 12 and continues the process.

Standard Time Signal Reception Process

Figure 15:
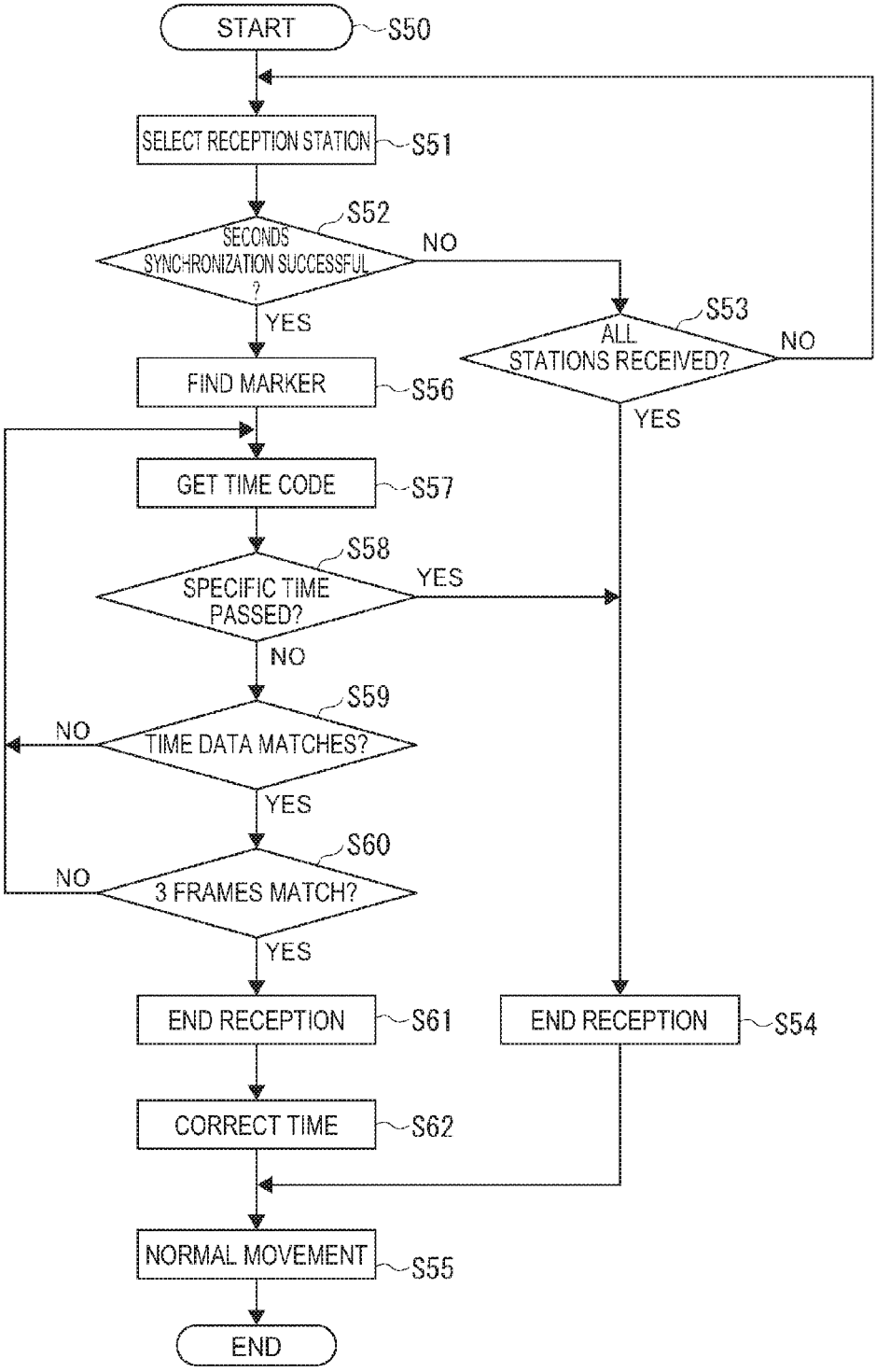
FIG. 15 is a flow chart of the standard time signal reception process in this embodiment.

The standard time signal reception process (S50) shown in FIG. 15 is described next.

When the reception process starts, the controller 61 selects the reception station (type of standard time signal) (S51). As described above, the reception station is selected based on the positioning information acquired in the positioning reception process, or the time zone data selected and set by the use. If the previous reception process was successful, the previous reception station is used.

Next, the controller 61 executes a seconds synchronization process based on the TCO signal output from the binarization circuit 417 (S52). The controller 61 confirms seconds synchronization by determining if the rising edge of the input TCO signal is at a one-second interval.

If seconds synchronization in S52 fails (S52 returns NO), the controller 61 determines if reception of all stations has ended (S53). If S53 returns NO, the controller 61 returns to reception station selection in S51, selects a different reception station, and continues the process. Note that the "all stations" evaluated in S53 means all standard time signals that can be received by the electronic timepiece 1 (for example, if JJY40, JJY60, WWVB, BPC, DCF77, MSF can be received, all of these signals), or only the stations that can be received based on the positioning information acquired from the positioning calculation (for example, MSF and DCF77 if the positioning information indicates London).

If S53 returns YES, the controller 61 determines that a standard time signal cannot be received, ends the process (S54), and resumes normal operation of the movement (S55).

If the controller 61 determines in S52 that seconds synchronization was successful, it acquires the marker indicating the 0 second position in the time code for frame synchronization (S56). For example, in the JJY standard time signal of Japan, the point where the M marker follows the P0 marker denotes the starting point of the time code, and frame synchronization can be confirmed by detecting these contiguous markers.

When these markers are acquired and frame synchronization is confirmed, the controller 61 decodes the TCO signal output from the binarization circuit 417 and acquires the time code (TC) (S57).

Next, the controller 61 determines if a specific time (such as 5 minutes) has passed since reception started (S58). If S58 returns YES, the controller 61 determines that power would be consumed wastefully without being able to receive the standard time signal even if the reception process continues, therefore ends the reception process (S54), and resumes normal operation of the movement (S55).

If NO is returned in S58, the controller 61 determines if the time data is coherent (S59). More specifically, the controller 61 checks the parity bit or if the time data is a time that does not exist.

If YES is returned in S59, the controller 61 determines if 3 frames of data are coherent (S60). If the time data acquired from three continuous time codes are at a one minute interval, it determines the three frames are coherent.

The controller 61 returns to the time code acquisition process of S57 is S59 or S60 returns NO.

If S60 returns YES, the controller 61 ends the standard time signal reception process because the correct time code was acquired (S61). Next, the controller 61 corrects the internal time based on the acquired time code (S62), and then resumes normal operation of the movement (S55).

The standard time signal reception process executed when an automatic reception condition is met thus ends. When this standard time signal reception process ends, the controller 61 returns to S1 in FIG. 12 and continues the process.

Manual Reception Process

In this embodiment the standard time signal reception process executes only in an automatic reception process, but the GPS reception process can also be started manually by operating button A 36.

Figure 14:
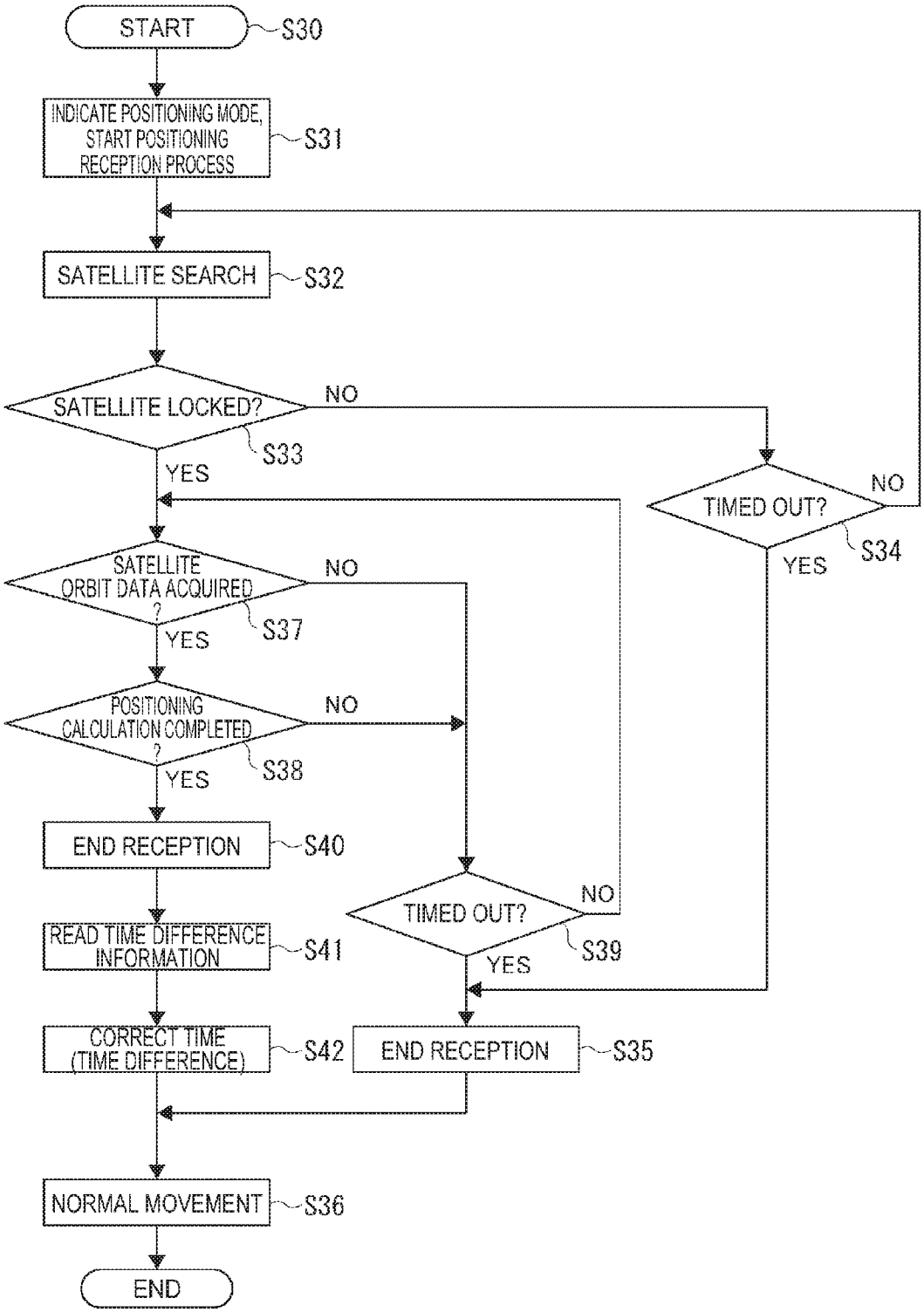
FIG. 14 is a flowchart of the positioning reception process in this embodiment.

When invoked manually, the timekeeping reception process is the same as the process as shown in FIG. 13, and the positioning reception process is the same as shown in FIG. 14. The manual reception process executes in the timekeeping mode if the storage battery 130 voltage is greater than or equal to a third threshold, and executes in the positioning mode if the storage battery 130 voltage is greater than or equal to a fourth threshold. In this embodiment, however, the third threshold and fourth threshold are respectively set lower than the first threshold and second threshold.

More specifically, as shown in Table 1, the first threshold at which the timekeeping reception process can execute automatically is 3.5 V, and the third threshold at which it can be manually executed is 3.45 V. The second threshold at which the positioning reception process can execute automatically is 3.6 V, and the fourth threshold at which it can be manually executed is 3.55 V. Note that as described above standard time signals are set to be received only in an automatic reception mode, and the voltage at which the standard time signal reception process can execute is set to 3.4 V ore more. As a result, because neither standard time signals or GPS satellite signals can be received if the voltage is less than 3.4 V, the prohibit-reception voltage is set to 3.4 V.

TABLE 1

| | Type | Timekeeping (using only time information) | Positioning (also using orbit information) |
|---|---|---|---|
| Standard time signal | automatic reception (scheduled) | prohibit-reception voltage <(3.4 V<=) | |
| GPS | automatic (outdoor detection) manual | first threshold <=(3.5 V<=) third threshold <=(3.45 V<=) | second threshold <=(3.6 V<=) fourth threshold <=(3.55 V<=) |

The manual reception process is described next.

If the controller 61 detects that button A 36 was pushed for 3 or more and less than 6 seconds, it detects the battery voltage. If the battery voltage is determined to be greater than or equal to the third threshold, the controller 61 executes the timekeeping reception process shown in FIG. 13. If the battery voltage is less than the third threshold, the controller 61 ends the reception process.

If button A 36 is pushed for 6 seconds or more, the controller 61 detects the battery voltage. If the battery voltage is determined to be greater than or equal to the fourth threshold, the controller 61 executes the positioning reception process shown in FIG. 14. If the battery voltage is less than the fourth threshold, the controller 61 ends the reception process.

If the reception process is started by the manual reception operation, the reception mode is indicated with the second hand 21, and the battery reserve is indicated with the hand 24. Because the user can therefore be informed of the reserve power left in the storage battery 130, can know why if the reception process does not execute, and be prevented from worrying.

Effect of the Embodiment

Because the electronic timepiece 1 has two reception units, a satellite signal receiver 5 and a standard time signal receiver 4, for receiving two types of signals, the probability of being able to acquire time information can be improved. Furthermore, because the satellite signal receiver 5 is configured so that the satellite signal reception controller 642 only determines the automatic reception condition is met if the battery voltage is greater than or equal to a first threshold, the system can be reliably prevented from shutting down due to the battery voltage dropping as a result of the satellite signal receiver 5 operating. Because the standard time signal receiver 4 is enabled by the standard time signal reception controller 645 to operate even if the battery voltage is less than the first threshold (3.5 V), the standard time signal receiver 4 can operate if the battery voltage is less than the first threshold but is greater than or equal to the prohibit-reception voltage (3.4 V). As a result, more opportunities to operate the standard time signal receiver 4 can be created, and deviation in the kept time can be reduced.

The standard time signal reception controller 645 can also execute the standard time signal reception process every day at a scheduled time because the standard time signal receiver 4 operates when the kept time reaches a set reception time. Because the satellite signal reception controller 642 operates the satellite signal receiver 5 only when standard time signal reception is not successful, the satellite signal receiver 5 can be operated when operation of the standard time signal receiver 4 is prioritized but a standard time signal cannot be received. As a result, time information can be acquired by the low current consumption standard time signal receiver 4 when the electronic timepiece 1 is used in a place where a standard time signal can be received, and time information can be acquired by the satellite signal receiver 5 when in a location where a standard time signal cannot be received. Power consumption by the reception process for acquiring time information can therefore be suppressed.

Because the reception mode selector 641 determines based on the positioning information acquired by the positioning reception process whether or not the current location is in an area where a standard time signal can be received, and controls operation of the standard time signal receiver 4 by the standard time signal reception controller 645, unnecessary operation of the standard time signal receiver 4 when not in an area where a standard time signal can be received can be prevented.

Furthermore, because the positioning reception process, which consumes more power than the timekeeping reception process, is executed only when the power reserve of the battery is greater than or equal to a second threshold, which is higher than the first threshold, battery power can be reliably prevented from dropping to the system shutdown level by the positioning reception process. Furthermore, because the first threshold can be set based on the current consumption of the timekeeping reception process, more opportunities to execute the timekeeping reception process can be created than if the first threshold is set according to the positioning reception process.

The satellite signal reception controller 642 operates the satellite signal receiver 5 with the timekeeping reception controller 643 if the manual timekeeping reception operation is performed with button A 36 and the reserve battery power is greater than or equal to a third threshold, and operates the satellite signal receiver 5 with the positioning reception controller 644 if the manual positioning reception operation is performed and the reserve battery power is greater than or equal to a fourth threshold. Because the third threshold and fourth threshold are lower than the first threshold and second threshold for the automated reception process, more opportunities to execute the satellite signal reception process can be created when the user starts reception manually. A drop in user convenience resulting from the reception process not executing even though the reception operation is performed can therefore be prevented.

Because being outdoors can be determined by the voltage detection circuit 74 detecting the power output of the solar cell 135, whether or not the electronic timepiece 1 is outdoors where satellite signal reception is easy can be determined. The probability of satellite signal reception succeeding automatically can therefore be improved.

By having a hand 24 and subdial 12 for displaying the remaining battery capacity, the remaining battery capacity can be displayed when reception starts. The user can therefore know that the reception process did not execute because of a low battery. Because the user can thus know why reception failed, the user can take appropriate action to charge the battery to meet the reception condition, and user convenience can be improved.

The thickness of the electronic timepiece 1 can also be minimized because parts that are relatively thick, such as the ring antenna 110, first to fifth stepper motors 141 to 145, the bar antenna 150, and storage battery 130 are disposed not overlapping each other in plan view.

Furthermore, because the timekeeping reception controller 643 executes the timekeeping reception process when the timekeeping reception operation is performed if the remaining battery capacity is less than the second threshold but is greater than or equal to the first threshold, there are more opportunities to acquire time information. The accuracy of the time displayed by the electronic timepiece 1 can therefore be improved.

Furthermore, because reception is prohibited if the remaining battery capacity is less than a prohibit-reception voltage, a system shutdown caused by the power supply dropping below the minimum operating voltage of the controller 61 can be reliably prevented.

Furthermore, because the display controller 620 indicates with the second hand 21 if positioning reception, timekeeping reception, or standard time signal reception is in progress, the user can easily check the current reception mode.

Because the power supply unit 7 includes a solar cell 135 and storage battery 130, the user can know to produce power with the solar cell 135 to charge the storage battery 130 if the remaining battery capacity drops below one of the thresholds and the reception process cannot execute. The reception process can therefore be run the next time the reception operation is performed if the remaining battery capacity rises above the thresholds.

Other Embodiments

The invention is not limited to the foregoing embodiment, and can be varied in many ways without departing from the scope of the accompanying claims.

Figure 17:
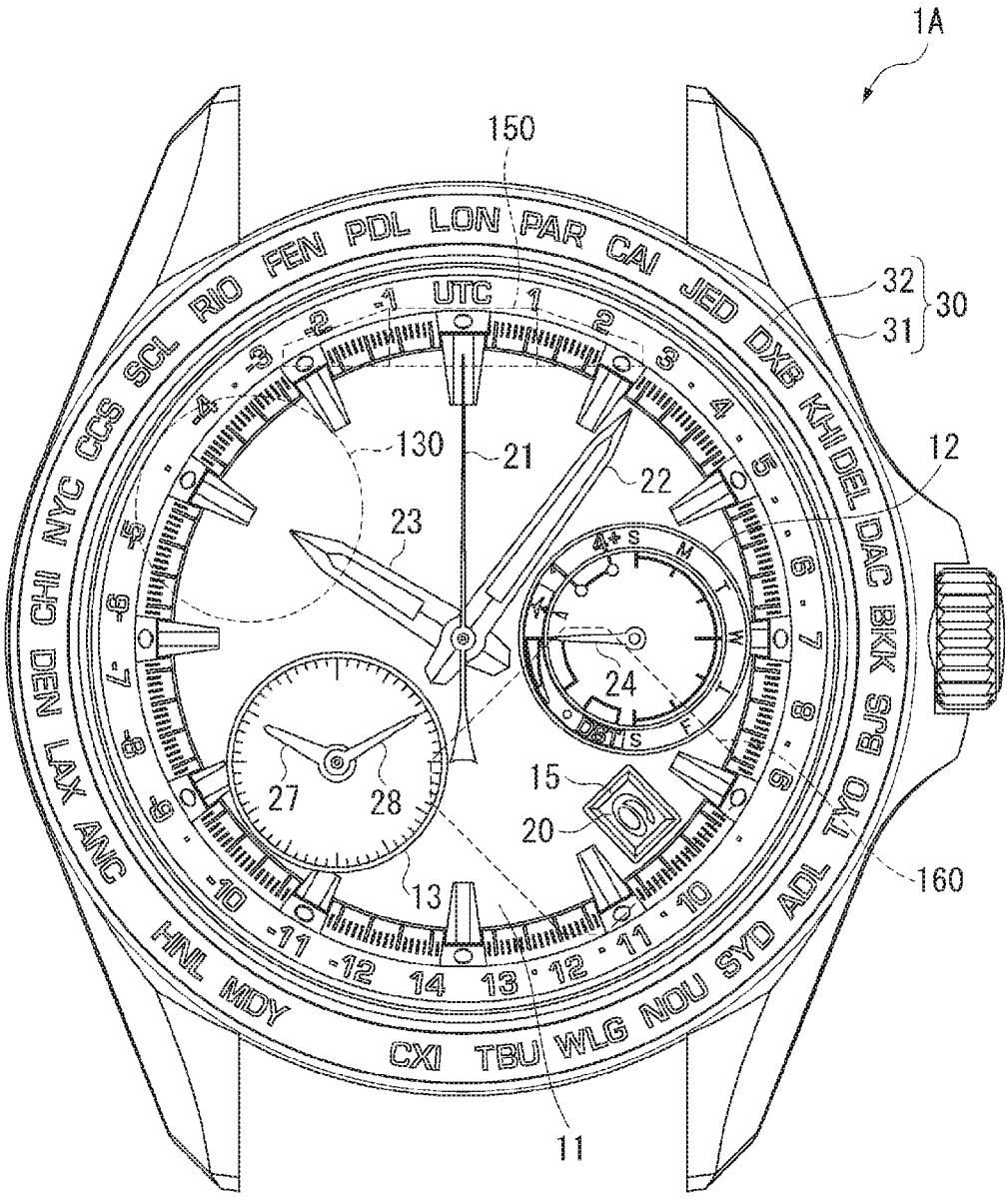
FIG. 17 is a plan view of an electronic timepiece according to another aspect.
Figure 18:
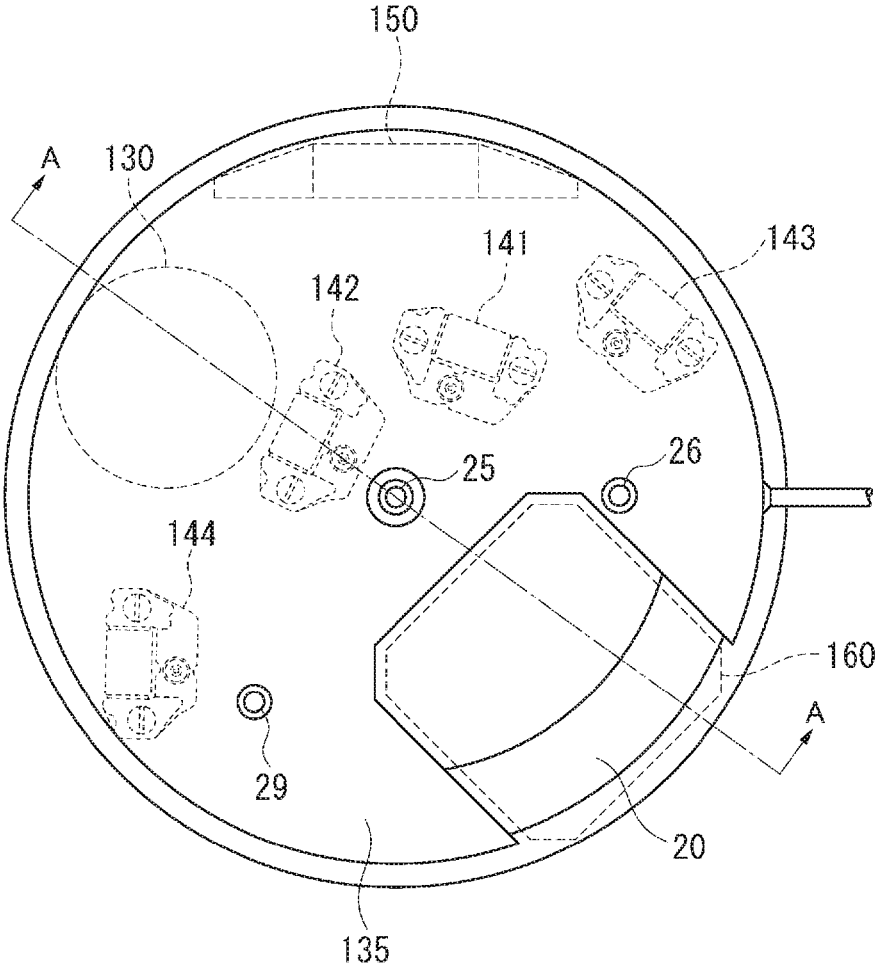
FIG. 18 illustrates the relative positions of the motor, battery, bar antenna, and patch antenna in a variation.
Figure 19:
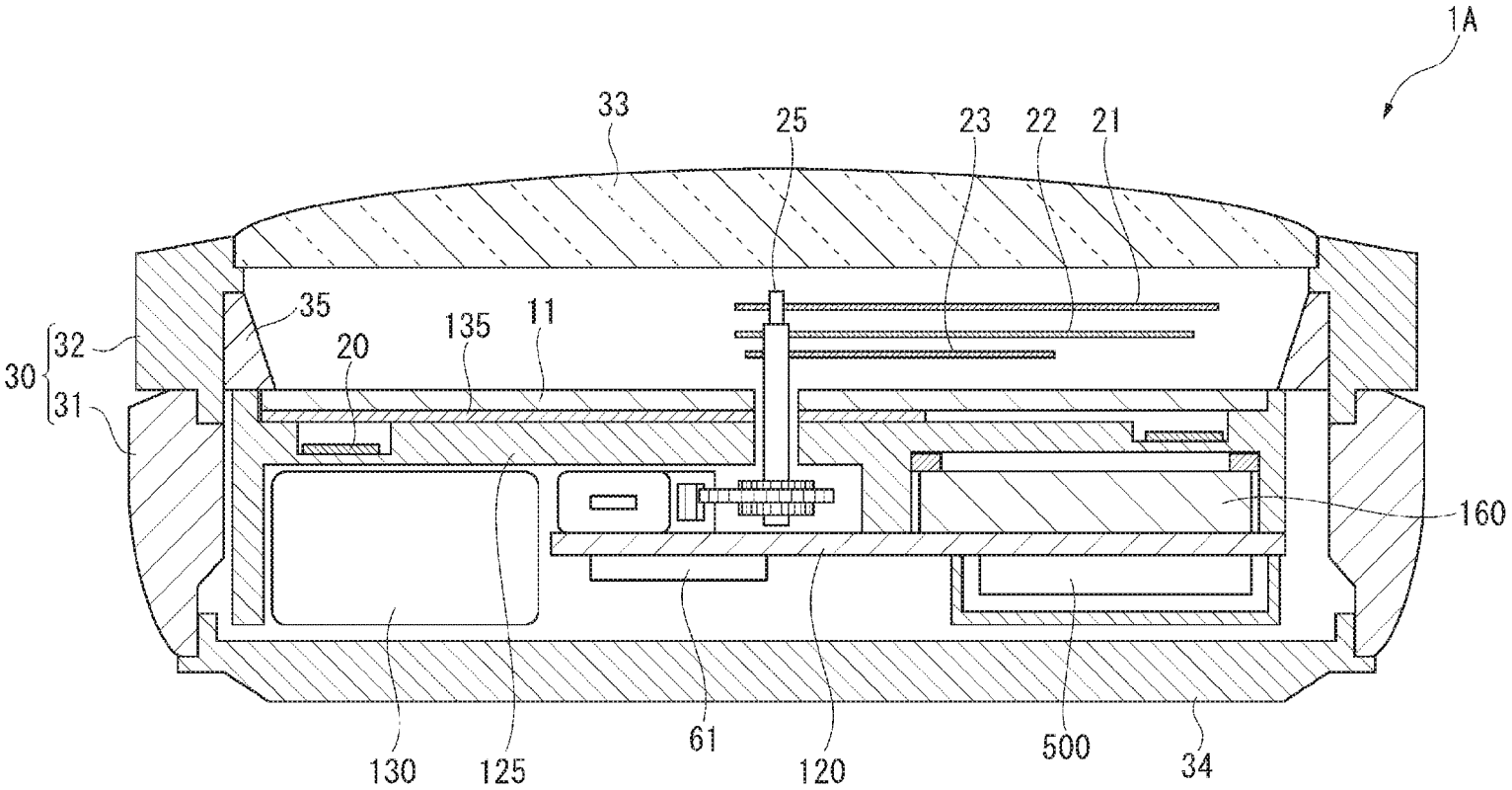
FIG. 19 is a section view of an electronic timepiece according to another embodiment.

For example, a patch antenna may be used as the antenna for receiving satellite signals. FIG. 17 to FIG. 19 illustrate an electronic timepiece 1A using a patch antenna. FIG. 19 is a section view through line A-A in FIG. 18. Note that like parts in this electronic timepiece 1A and the electronic timepiece 1 described above are identified by like reference numerals and further description thereof is omitted.

This electronic timepiece 1A has second hand 21, minute hand 22, and hour hand 23 that turn on a center arbor 25 disposed as center hands of the dial 11, a subdial 12 and a hand 24 that turns on a pivot 26 disposed near 3:00 on the dial 11, and a second subdial 13 and hands 27, 28 that turn on an arbor 29 between 7:00 and 8:00 on the dial 11.

Hands 22, and 23 are driven by a first stepper motor 141 and indicate the minute and hour of a first time (local time). Hand 21 is driven by a second stepper motor 142 and indicates the second of the first time. Hand 24 is a mode indicator driven by the third stepper motor 143, and as in the foregoing embodiment indicates on the subdial 12 the day of the week, remaining battery capacity, and whether or not daylight saving time is set. In this electronic timepiece 1A, hand 24 also indicates if an airplane mode is set, and whether the GPS satellite signal reception mode is the timekeeping mode or the positioning mode.

The hands 27, 28 on the second subdial 13 are dual time hands indicating the hour and minute of a second time, and normally indicate the set home time. These hands 27, 28 are driven by a fourth stepper motor 144.

The date window 15 through which the date indicator 20 is visible is formed between 4:00 and 5:00 on the dial 11 of the electronic timepiece 1A. The date indicator 20 is driven by the third stepper motor 143. More specifically, the third stepper motor 143 is used to drive both hand 24 and the date indicator 20 by driving a wheel train for the hand 24 or a wheel train for the date indicator 20 by switching the direction in which the third stepper motor 143 turns.

In this electronic timepiece 1A, a patch antenna 160 is disposed between 4:00 and 5:00 on the dial 11 where the date window 15 is formed, and the storage battery 130 is disposed at 10:00 on the dial 11 on the opposite side of the arbor 25 as the patch antenna 160. A notch is formed in the solar cell 135 where it overlaps the patch antenna 160 in plan view. As a result, satellite signal reception by the patch antenna 160 is not obstructed even if a solar cell 135 with a metal substrate is used.

The bar antenna 150 for receiving standard time signals is located at 12:00 on the dial 11. A notch is not formed in the solar cell 135 where it overlaps the bar antenna 150 in plan view, but long-wave standard time signals can be received without notching the solar cell 135 if the leads of the bar antenna 150 are outside of the solar cell 135.

hand 24 normally indicates the day of the week, and indicates the storage battery 130 voltage (remaining battery capacity) only when button A 36 is pushed in the foregoing embodiment, but a hand that normally indicates the capacity of the storage battery 130 may also be provided. In this event, the user can easily informed of a drop in the storage battery 130 voltage, and the user can therefore be prompted to charge the storage battery 130 with the solar cell 135.

In the foregoing embodiment, the third threshold is the same voltage as the first threshold, and the fourth threshold is the same voltage as the second threshold. However, the foregoing embodiment is advantageous in that the probability of being able to execute the reception process with the manual reception operation can be improved. The first threshold and third threshold may also be set to the same value. However, the foregoing embodiment is advantageous in that the probability of being able to execute the timekeeping reception process can be improved.

The time display of the electronic timepiece in the foregoing examples is embodied by a dial 11 and second hand 21, minute hand 22, and hour hand 23, but the invention is not so limited. The electronic timepiece may have a time display embodied by an LCD panel, for example. In this event, the driver that drives the time display is embodied by a driver that drives a liquid crystal display panel.

The electronic timepiece also simply needs a time display function, and the time display does not need to be a dedicated display for displaying time. Examples of such electronic timepieces include heart rate monitors worn on the user's wrist, GPS loggers that are worn on the user's wrist and monitor and log the current location while the user is jogging, and other types of wearable devices.

A GPS satellite S is used as an example of a positioning information satellite above, but the invention is not so limited. For example, the positioning information satellite may be a satellite used in a Global Navigation Satellite System (GNSS) such as Galileo (EU) or GLONASS (Russia). Geostationary satellites in a geostationary satellite-based augmentation system (SEAS), and quasi-zenith satellites (such as Michibiki) used in a regional navigation satellite system (RNSS) that can only be accessed in specific regions, can also be used.

The types of standard time signals that can be received are also not limited to the standard time signals of the five countries described above, and configurations that receive only some of these standard time signals are also conceivable.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2015-114682, filed Jun. 5, 2015 is expressly incorporated by reference herein.

What is claimed is:

1. An electronic timepiece comprising:

a satellite signal receiver that receives satellite signal and acquires time information;

a standard time signal receiver that receives a standard time signal and acquires time information;

a battery that supplies power to the satellite signal receiver and the standard time signal receiver;

a reserve power detector that detects the reserve power of the battery;

a satellite signal reception controller that controls operation of the satellite signal receiver; and a standard time signal reception controller that controls operation of the standard time signal receiver;

wherein the satellite signal reception controller operates the satellite signal receiver if the automatic reception condition for the satellite signal is met when the reserve power detected by the reserve power detector is greater than or equal to a first threshold, and does not operate the satellite signal receiver if an automatic reception condition for the satellite signal is met when the reserve power detected by the reserve power detector is less than the first threshold; and the standard time signal reception controller operates the standard time signal receiver if an automatic reception condition for the standard time signal is met when the reserve power detected by the reserve power detector is greater than or equal to the first threshold or is less than the first threshold.

2. The electronic timepiece described in claim 1, wherein:

the standard time signal reception controller determines the automatic reception condition for the standard time signal is met and operates the standard time signal receiver when the time kept by the electronic timepiece reaches a previously set reception time; and the satellite signal reception controller operates the satellite signal receiver when the standard time signal receiver operated by the standard time signal reception controller does not succeed at acquiring time information by receiving the standard time signal, the electronic timepiece is determined to be outdoors, and the reserve power is greater than or equal to the first threshold.

3. The electronic timepiece described in claim 1, wherein:

the satellite signal receiver can execute a timekeeping reception process to acquire time information based on the satellite signal, and a positioning reception process to calculate positioning information based on the satellite signal; and when the located identified by the positioning information acquired by the positioning reception process is outside a previously set standard time signal reception area, the standard time signal reception controller does not operate the standard time signal receiver, and the satellite signal reception controller operates the satellite signal receiver if the reserve power is greater than or equal to the first threshold and the electronic timepiece is determined to be outdoors.

4. The electronic timepiece described in claim 1, wherein:

the satellite signal receiver can execute a timekeeping reception process to acquire time information based on the satellite signal, and a positioning reception process to calculate positioning information based on the satellite signal; and the satellite signal reception controller operates the satellite signal receiver and executes the timekeeping reception process when a previously set timekeeping reception condition is met and the reserve power is greater than or equal to the first threshold, and operates the satellite signal receiver and executes the positioning reception process when a previously set positioning reception condition is met and the reserve power is greater than or equal to a second threshold that is greater than the first threshold.

5. The electronic timepiece described in claim 1, wherein:

the satellite signal reception controller operates the satellite signal receiver when a reception operation of an operating member is detected, and the reserve power is greater than or equal to a threshold that is lower than the threshold set for the automatic reception condition.

6. The electronic timepiece described in claim 1, further comprising:

a solar cell; and a power output detector that detects the power output of the solar cell;

wherein the satellite signal reception controller determines whether or not the electronic timepiece is outdoors based on the power output detected by the power output detector, and determines the automatic reception condition for the satellite signal is met if the electronic timepiece is determined to be outdoors.

7. The electronic timepiece described in claim 1, further comprising:

a display able to display the reserve power detected by the reserve power detector, the display displaying the reserve power at least when reception starts.

8. The electronic timepiece described in claim 1, further comprising:

a hand; and a motor that drives the hand;

the standard time signal receiver including a bar antenna for receiving a standard time signal; and the satellite signal receiver having a ring antenna for receiving a satellite signal;

the motor, the bar antenna, and the battery being disposed in a plan view of the electronic timepiece on the inside circumference side of the ring antenna at mutually non-overlapping plane positions.

9. The electronic timepiece described in claim 1, further comprising:

a hand; and a motor that drives the hand;

the standard time signal receiver including a bar antenna for receiving a standard time signal; and the satellite signal receiver having a patch antenna for receiving a satellite signal;

the motor, the bar antenna, the patch antenna, and the battery being disposed in a plan view of the electronic timepiece at mutually non-overlapping plane positions.

10. A control method of an electronic timepiece including a satellite signal receiver that receives satellite signals and acquires time information;

a standard time signal receiver that receives a standard time signal and acquires time information;

a battery that supplies power to the satellite signal receiver and the standard time signal receiver;

a reserve power detector that detects the reserve power of the battery; and a reception controller;

the control method comprising steps of the reception controller:

operating the satellite signal receiver if an automatic reception condition for the satellite signal is met when the reserve power detected by the reserve power detector is greater than or equal to a first threshold;

not operating the satellite signal receiver if the automatic reception condition for the satellite signal is met when the reserve power detected by the reserve power detector is less than the first threshold; and operating the standard time signal receiver if an automatic reception condition for the standard time signal is met when the reserve power detected by the reserve power detector is greater than or equal to the first threshold or is less than the first threshold.

* * * * *